US007593544B2

(12) United States Patent
Downs, III et al.

(10) Patent No.: US 7,593,544 B2
(45) Date of Patent: Sep. 22, 2009

(54) MANUAL DEALING SHOE WITH CARD FEED LIMITER

(75) Inventors: Justin G. Downs, III, Henderson, NV (US); James R. Roberts, North Las Vegas, NV (US); Sion D. Walsh, Las Vegas, NV (US)

(73) Assignee: Shuffle Master, Inc., Las Vegas, NV (US)

( * ) Notice: Subject to any disclaimer, the term of this patent is extended or adjusted under 35 U.S.C. 154(b) by 472 days.

(21) Appl. No.: 11/417,894

(22) Filed: May 3, 2006

(65) Prior Publication Data

US 2006/0279040 A1 Dec. 14, 2006

Related U.S. Application Data

(63) Continuation-in-part of application No. 11/152,475, filed on Jun. 13, 2005.

(51) Int. Cl.
*G06K 9/00* (2006.01)
*A63B 71/00* (2006.01)
*A63F 1/12* (2006.01)

(52) U.S. Cl. ..... 382/100; 273/148 A; 273/149 R

(58) Field of Classification Search ..... 273/149 R, 273/292, 274, 149 P, 309, 303, 148 R, 148 A; 463/13, 11, 29, 12, 16; 209/587, 547, 939; 382/100

See application file for complete search history.

(56) References Cited

U.S. PATENT DOCUMENTS 4,494,197 A 1/1985 Troy et al.
4,667,959 A 5/1987 Pfeiffer et al.
4,750,743 A 6/1988 Nicoletti
4,926,327 A 5/1990 Sidley
4,995,615 A 2/1991 Cheng (Continued)

FOREIGN PATENT DOCUMENTS

WO WO 00/51076 8/2000

OTHER PUBLICATIONS

Press Release for Alliance Gaming Corp., Jul. 26, 2004—Alliance Gaming Announces Contract With Galaxy Macau for New MindPlay Baccarat Table Technology, http://biz.yahoo.com/prnews.

(Continued)

*Primary Examiner*—Sheela C Chawan
(74) *Attorney, Agent, or Firm*—Mark A. Litman & Associates, P.A.

(57) ABSTRACT

A playing card delivery shoe is used in the play of the casino table card game of baccarat or blackjack or any game where cards are pulled one at a time from the shoe. The apparatus comprises a reader or an imager that scans lines bisecting the image at spaced intervals. The scanning occurs on playing cards in at least the region where suit and rank symbols are provided. The scanner output is a series of voltages that are converted to binary information. This binary information is compared to stored binary information to determine rank and suit. The upper surface of the output end of the shoe contains a partial barrier for cards being scanned. The partial barrier has an elevated surface and limits a size of a pathway so that only one card can be removed at a time.

33 Claims, 14 Drawing Sheets

U.S. PATENT DOCUMENTS 5,179,517 A 1/1993 Sarbin et al.
5,209,476 A 5/1993 Eiba
5,224,712 A 7/1993 Laughlin et al.
5,257,179 A 10/1993 DeMar
5,276,312 A 1/1994 McCarthy
5,283,422 A 2/1994 Storch et al.
5,356,145 A 10/1994 Verschoor
5,362,053 A 11/1994 Miller
5,374,061 A 12/1994 Albrecht
5,470,079 A 11/1995 LeStrange et al.
5,586,766 A 12/1996 Forte et al.
5,586,936 A 12/1996 Bennett et al.
5,605,334 A 2/1997 McCrea, Jr.
5,613,912 A 3/1997 Slater
5,655,961 A 8/1997 Acres et al.
5,669,816 A 9/1997 Garczynski et al.
5,681,039 A 10/1997 Miller
5,722,893 A 3/1998 Hill et al.
5,735,525 A 4/1998 McCrea, Jr.
5,772,505 A 6/1998 Garczynski et al.
5,779,546 A 7/1998 Meissner et al.
5,781,647 A 7/1998 Fishbine et al.
5,788,574 A 8/1998 Ornstein et al.
5,803,808 A 9/1998 Strisower
5,911,626 A 6/1999 McCrea, Jr.
5,919,090 A 7/1999 Mothwurf
5,941,769 A 8/1999 Order
5,989,122 A 11/1999 Roblejo
6,039,650 A 3/2000 Hill
6,071,190 A 6/2000 Weiss et al.
6,093,103 A 7/2000 McCrea, Jr.
6,117,012 A 9/2000 McCrea, Jr.
6,126,166 A 10/2000 Lorson et al.
6,165,069 A 12/2000 Sines et al.
6,217,447 B1 4/2001 Lofink et al.
6,250,632 B1 6/2001 Albrecht
6,267,248 B1 7/2001 Johnson et al.
6,267,671 B1 7/2001 Hogan
6,270,404 B2 8/2001 Sines et al.
6,293,864 B1 9/2001 Romero
6,299,536 B1 * 10/2001 Hill ..... 463/47
6,313,871 B1 11/2001 Schubert
6,346,044 B1 2/2002 McCrea, Jr.
6,361,044 B1 3/2002 Block et al.
6,403,908 B2 6/2002 Stardust et al.
6,446,864 B1 9/2002 Kim et al.
6,460,848 B1 10/2002 Soltys et al.
6,517,435 B2 2/2003 Soltys et al.
6,517,436 B2 2/2003 Soltys et al.
6,520,857 B2 2/2003 Soltys et al.
6,527,271 B2 3/2003 Soltys et al.
6,530,836 B2 3/2003 Soltys et al.
6,530,837 B2 3/2003 Soltys et al.
6,532,297 B1 3/2003 Lindquist
6,533,276 B2 3/2003 Soltys et al.
6,533,662 B2 3/2003 Soltys et al.
6,579,180 B2 6/2003 Soltys et al.
6,579,181 B2 6/2003 Soltys et al.
6,582,301 B2 6/2003 Hill
6,582,302 B2 6/2003 Romero
6,585,586 B1 7/2003 Romero
6,595,857 B2 7/2003 Soltys et al.
6,616,535 B1 9/2003 Nishizaki et al.
6,622,185 B1 9/2003 Johnson et al.
6,629,889 B2 10/2003 Mothwurf
6,629,894 B1 10/2003 Purton
6,638,161 B2 10/2003 Soltys et al.
6,645,068 B1 11/2003 Kelly et al.
6,645,077 B2 11/2003 Rowe
6,652,379 B2 11/2003 Soltys et al.
6,663,490 B2 12/2003 Soltys et al.
6,666,768 B1 12/2003 Akers
6,685,567 B2 2/2004 Cockerille et al.
6,685,568 B2 2/2004 Soltys et al.
6,688,979 B2 2/2004 Soltys et al.
6,712,696 B2 3/2004 Soltys et al.
6,719,634 B2 4/2004 Mishina et al.
6,746,333 B1 6/2004 Onda et al.
6,758,751 B2 7/2004 Soltys et al.
6,758,757 B2 7/2004 Luciano, Jr. et al.
6,804,763 B1 10/2004 Stockdale et al.
7,231,812 B1 * 6/2007 Lagare ..... 73/40.5 R
7,264,241 B2 * 9/2007 Schubert et al. ..... 273/149 R
7,322,576 B2 * 1/2008 Grauzer et al. ..... 273/149 R
7,407,438 B2 * 8/2008 Schubert et al. ..... 463/22
2001/0036231 A1 11/2001 Easwar et al.
2001/0036866 A1 11/2001 Stockdale et al.
2002/0107067 A1 8/2002 McGlone et al.
2002/0187830 A1 12/2002 Stockdale et al.
2003/0087694 A1 5/2003 Storch
2004/0116179 A1 6/2004 Nicely et al.
2005/0062227 A1 * 3/2005 Grauzer et al. ..... 273/149 R
2005/0242500 A1 11/2005 Downs, III

OTHER PUBLICATIONS

Tracking the Tables, by Jack Bularsky, Casino Journal, May 2004, vol. 17, No. 5, pp. 44-47.

* cited by examiner

MANUAL DEALING SHOE WITH CARD FEED LIMITER

RELATED APPLICATION DATA

This application is a continuation-in-part of pending U.S. application Ser. No. 11/152,475, filed Jun. 13, 2005. The content of this application is incorporated by reference in its entirety.

BACKGROUND OF THE INVENTION

1. Field of the Invention

The present invention relates to the field of gaming, the filed of casino table card gaming, the play of baccarat at a casino card table, and the use of equipment for the delivery of playing cards.

2. Background of the Art

Cards are ordinarily provided to players in casino table card games either directly from a deck held in the dealer's hands or with cards removed by the dealer from a dealing shoe or dealing rack. The original dealing racks were little more than trays that supported the deck(s) of cards and allowed the dealer to remove the front card (with its back facing the table to hide the rank of the card) and deliver it to a player. Over the years, both stylistic and functional changes have been made to dealing shoes, which have been used for blackjack, poker, baccarat and other casino table card games.

U.S. Pat. Nos. 6,585,586; 6,582,302; and 6,293,864 (ROMERO) describe a gaming assembly to play a variation of the game of baccarat, the gaming assembly including a computer processor assembly, a display assembly and at least one user actuatable selector assembly. The computer processor assembly is structured to generate a player's hand and a banker's hand in accordance with rules of baccarat, one of those hands being designated the user's hand. Further, the computer processor assembly is structured to determine a winning hand in accordance with the rules of baccarat, designating the user as a winner if the user's hand is also the winning hand. Additionally, the computer processor assembly is structured to monitor consecutive ones of the user's hands and to indicate a bonus payout to the user in the event that consecutive ones of the user's hands have a final number count equal to a natural nine.

U.S. Pat. No. 4,667,959 (PFEIFFER) describes a card apparatus having a card hopper adapted to hold from one to at least 104 cards, a card carousel having slots for holding cards, an injector for sequentially loading cards from the hopper into the carousel, multiple output ports, ejectors for delivering cards from the carousel to any one of the multiple output ports, and a control board and sensors, all housed in a housing. The apparatus is also capable of communicating with selectors which are adjustable for making card selections. The injector has three rollers driven by a motor via a worm gear. A spring loaded lever keeps cards in the hopper pressed against the first roller. The ejectors are pivotally mounted to the base of the housing beneath the carousel and comprise a roller driven by a motor via gears and a centripetal clutch. A control board keeps track of the identity of cards in each slot, card selections, and the carousel position. Cards may be ordinary playing cards or other cards with bar codes added for card identification by the apparatus.

U.S. Pat. No. 4,750,743 (NICOLETTI) describes the use of a mechanical card dispensing means to advance cards at least part way out of the shoe. The described invention is for a dispenser for playing cards comprising: a shoe adapted to contain a plurality of stacked playing cards, the playing cards including a leading card and a trailing card; the shoe including a back wall, first and second side walls, a front wall, a base, and an inclined floor extending from the back wall to proximate the front wall and adapted to support the playing cards; the floor being inclined downwardly from the back wall to the front wall; the front wall having an opening and otherwise being adapted to conceal the leading card; and the front wall, side walls, base and floor enclosing a slot positioned adjacent the floor, the slot being sized to permit a playing card to pass through the slot; card advancing means contacting the trailing card and adapted to urge the stacked cards down the inclined floor; card dispensing means positioned proximate the front wall and adapted to dispense a single card at a time, the card dispensing means including leading card contact means adapted for rotation about an axis parallel to the leading card, whereby rotation of the leading card contact means displaces the leading card relative to the card stack and into a predetermined position extending out of the shoe from the slot; and an endless belt located in the opening in the front wall for rotating the leading card contact means, the endless belt having an exterior surface securely engaging the leading card contact means and being adapted to be displaced by an operator.

U.S. Pat. No. 5,779,546 (MEISSNER) describes a method and apparatus to enable a game to be played based upon a plurality of cards. An automated dealing shoe dispenses each of the cards and recognizes each of the cards as each of the cards is dispensed. Player stations are also included. Each player station enables a player to enter a bet, request that a card be dispensed or not dispensed, and to convert each bet into a win or a loss based upon the cards that are dispensed by the automated dealing shoe.

U.S. Pat. No. 5,989,122 (ROBLEJO) relates to an apparatus for randomizing and verifying sets of playing cards. Also, the invention relates to a process of providing such an apparatus; feeding to the apparatus one or more cards either after they have been played in a game or from an unrandomized or unverified set of cards; and manually retrieving a verified true set of cards from the apparatus. Also, the invention relates to a process of playing in a casino setting or simulated casino setting, a card game comprising providing such an apparatus, feeding unverified sets of playing cards to the apparatus, and recovering verified true sets of cards from the apparatus.

U.S. Pat. No. 5,374,061 (Albrecht) discloses a dealing shoe that uses a specially coded deck of cards indicating the value and suit of the card or a value related to the count of the card. The shoe also determines whether the card belongs to a particular set of cards. A code is sensed on the card and sends the detected signal to a processor. The processor determines a running count, a betting count, a true count or other information related to the profitability of a particular wager or particular action, such as an insurance bet as well as an indication of whether the card belongs to the particular set of cards assigned to the table. The counts are displayed centrally and/or remotely from the shoe that dispenses the cards. The electronics for the system may be internally included as part of the shoe or externally included as a separate unit in which the shoe is secured. The reading head is provided on the floor of the exit end of the shoe.

U.S. Pat. Nos. 5,605,334; 6,093,103 and 6,117,012 (McCREA) disclose apparatus for use in a security system for card games. A secure game table system comprises: a shoe for holding each card from said at least one deck before being dealt by said dealer in said hand, said shoe having a detector for reading at least the value and the suit of said each card.

U.S. Pat. No. 6,250,632 (ALBRECHT) describes an apparatus and method for sorting cards into a predetermined sequence. One embodiment provides a deck holding area in which cards are held for presenting a card to a reading head for reading the characters on the face of the card. The apparatus also has a tray having a sequence of slots and a card moving mechanism for moving the presented card from the deck holding area into one of the slots. The tray is connected to a tray positioning mechanism for selectively positioning the tray to receive a card in one of the slots from the card moving mechanism. A controller is connected to the read head, the card moving mechanism, and the tray positioning mechanism. The controller controls the reading of each of the cards by the read head and identifies the value of each card read, and also controls the card moving mechanism to move each of the cards to a slot of the tray positioned by the tray positioning mechanism according to the predetermined sequence of values.

U.S. Pat. No. 6,267,248 (JOHNSON) describes a collation and/or sorting apparatus for groups of articles that is exemplified by a sorting and/or shuffling device for playing cards. The apparatus comprises a sensor (15) to identify articles for collation and/or sorting, feeding means to feed cards from a stack (11) past the sensor (15) to a delivery means (14) adapted to deliver cards individually to a preselected one of a storing means (24) in an indexable magazine (20). A microprocessor (16) coupled to the feed means (14), delivery means (18), sensor (15) and magazine (20) determines according to a preprogrammed routine whether cards identified by sensor (15) are collated in the magazine (20) as an ordered deck of cards or a randomly ordered or "shuffled" deck.

U.S. Pat. No. 6,403,908 (STARDUST) describes an automated method and apparatus for sequencing and/or inspecting decks of playing cards. The method and apparatus utilizes pattern recognition technology or other image comparison technology to compare one or more images of a card with memory containing known good images of a complete deck of playing cards to identify each card as it passes through the apparatus. Once the card is identified, it is temporarily stored in a location corresponding to or identified according to its position in a properly sequenced deck of playing cards. If a playing card has not been rejected based upon improper color of the back of the card, the embedded processor then determines the rank and suit (position) of the card in a properly sequenced deck of cards, using digital image processing to compare the digital images obtained from that specific playing card against the plurality of stored card images which comprise a complete 52-card deck. This step either comprises an application of pattern recognition technology or other image comparison technology.

U.S. Pat. No. 6,217,447 (LOFINK) describes a method and system for generating displays related to the play of Baccarat. Cards dealt to each of the Banker's and Player's hands are identified as by scanning and data signals are generated. The card identification data signals are processed to determine the outcome of the hand. Displays in various formats to be used by bettors are created from the processed identification signals including the cards of the hand played, historical records of outcomes and the like. The display can also show bettors expected outcomes and historical bests. Bettors can refer to the display in making betting decisions.

U.S. Pat. Nos. 6,582,301; 6,299,536; 6,039,650; and 5,722,893 (HILL) describes a dealing shoe that has a card scanner that scans indicia on a playing card as the card moves along and out of a chute by manual direction by the dealer. The scanner can be one of several different types of devices that will sense each card as it is moved downwardly and out of the shoe. A feed forward neural-network is trained, using error back-propagation to recognize all possible card suits and card values sensed by the scanner.

U.S. Pat. No. 6,126,166 (LORSON) describes a system for monitoring play of a card game between a dealer and one or more players at a playing table, comprising: (a) a card-dispensing shoe comprising one or more active card-recognition sensors positioned to generate signals corresponding to transitions between substantially light background and dark pip areas as standard playing cards are dispensed from the card-dispensing shoe, without generating a bit-mapped image of each dispensed standard playing card; and (b) a signal processing subsystem.

U.S. Pat. No. 5,941,769 (ORDER) describes a device for professional use in table games of chance with playing cards and gaming chips (jettons), in particular the game of "Black Jack." An automatically working apparatus is provided which will register and evaluate all phases of the run of the game automatically. This is achieved by a card shoe with an integrated device for recognition of the value of the drawn cards using an optical recognition device and mirroring into a CCD-image converter.

U.S. Pat. No. 6,460,848 (SOLTYS)—MindPlay LLC U.S. patent describes a system that automatically monitors playing and wagering of a game, including the gaming habits of players and the performance of employees. A card deck reader automatically reads a symbol from each card in a deck of cards before a first one of the cards is removed. The symbol identifies a respective rank and suit of the card. There are numerous other patents assigned to MindPlay LLC, including at this time U.S. Pat. Nos. 6,712,696; 6,688,979; 6,685,568; 6,663,490; 6,652,379; 6,638,161; 6,595,857; 6,579,181; 6,579,180; 6,533,662; 6,533,276; 6,530,837; 6,530,836; 6,527,271; 6,520,857; 6,517,436; and 6,517,435.

WO 00/51076 and U.S. Pat. No. 6,629,894 (PURTON) disclose a card inspection device that includes a first loading area adapted to receive one or more decks of playing cards. A drive roller is located adjacent the loading area and positioned to impinge on a card if a card were present in the loading area. The loading area has an exit through which cards are urged, one at a time, by a feed roller. A transport path extends from the loading area exit to a card accumulation area. The transport path is further defined by two pairs of transport rollers, one roller of each pair above the transport path and one roller of each pair below the transport path. A camera is located between the two pairs of transport rollers, and a processor governs the operation of a digital camera and the rollers. A printer produces a record of the device's operation based on an output of the processor, and a portion of the transport path is illuminated by one or more blue LEDs.

Existing card recognition technology used in card handling equipment tends to be bulky and expensive. Current systems require excessive amounts of computing power and yet these systems show significant problems in the consistency of card reading capability. Significant computing power in known systems resides outside of the shoe.

Each of the references identified in the Background of the Art and the remainder of the specification are incorporated herein by reference in their entirety as part of the enabling disclosure for such elements as apparatus, methods, hardware and software.

BRIEF DESCRIPTION OF THE INVENTION

An improved system for obtaining information on the rank and suit of cards from standard symbols on playing cards focuses on using:

1) a simple shoe design or a mechanized shoe design;
2) small spaced line scans;
3) a position sensor to trigger a line scan;

4) binary data sets;
5) generating a series of binary values from the scanner output so that more sophisticated shading or optical density readings are unnecessary;
6) simple template matching without image extraction;
7) complex data analysis techniques;
8) a novel card feed limiting device to prevent more than one card from passing over the card reading system at one time; and
9) a monochromatic light source for the imager.

One preferred construction embodying these objectives uses a contact image sensor (CIS) module incorporated into a card dealing shoe. The CIS module is used to output acquired signal data from the sensor as a vector, and hardware (such as ASIC or preferably an FPGA) compares the acquired signal data to stored signal data in order to determine rank and suit information. This is done by comparing the acquired vector data (or a signal vector) with known (high quality) vectors, and the known vector with the highest correlation to the signal vector identifies suit and rank and this data is then sent to a data storage medium or a processor.

The proposed device can also be used as a stand-alone image reading device for playing cards and it can replace camera/imaging/processor systems presently used in mechanized card delivery shoes, in discard racks, in deck verification devices, on card tables, in card sorters and in shufflers with card reading capacity.

Additional features proposed by the inventors enable reading of card images even when the cards are slightly misaligned or the print on the card is not in the expected location. This is accomplished by using column sums of selected indices of signals, and extracting the location of symbols on the cards as they move over the CIS sensor.

An optical position sensor is provided on the CIS module carrying the CIS sensor to perform two distinct functions: 1) sense the distance that the card moves; and 2) sense the presence (or absence) of a card. The sensor continuously provides signal output to the FPGA regarding changes in the card's position. Communication in one example of the invention is through a digital I/O port.

The CIS sensor in one form of the invention is 1-dimensional line sensor and can be triggered to read a line when the card moves at least a predetermined distance or at a time interval when the card is moving. Alternatively, when the card reading system is incorporated into a mechanized shoe, the line sensor senses cards when the card is stationary. Stationary reading typically requires a card moving mechanism.

The line scan information can be provided as a string of binary numbers corresponding to the various voltages output in response to scanning each segment of the scanned line, as opposed to providing detailed image data on the line. For example, a line scan can provide voltage output that can be classified as having a gray scale values between 0 (white) and 255 (black) or any other linear or exponential scale. Each line would be represented by a single value between 0 and 255, for example. This information is converted to binary values either before or after delivery to the FPGA. For example, a voltage corresponding to a white value of 10 is converted to a zero, and a black value of 180 is converted into a value of 1. Vectors (multiple line scan values) taken from a single card are correlated with known scan line vectors through the hardware (e.g., ASIC or FPGA) and the closest correlation results in identification of the suit and rank of the card.

The use of a physical device or component on an interior surface of the exit port of the delivery shoe assists in limiting the number of cards that can be pulled at one time from the shoe. For example, a card dealing shoe is provided with a declining card support surface and two opposing side walls for retaining a group of pre-shuffled cards. The dealing shoe has an exit end with an opening for the manual removal of individual cards. Located proximate the exit end of the shoe is a CIS sensor and associated position sensor. Each card is individually scanned as the card is removed manually from the shoe. A preferred physical device is a card feed limiter. The card feed limiter is provided to assure that only a single card exits the shoe at one time, and that the printed material on the card comes into close proximity to the CIS sensor, and preferably into contact with the CIS sensor, facilitating the scanning of the card markings.

DETAILED DESCRIPTION OF THE INVENTION

The present invention is a novel apparatus for delivering cards to a card game. Although the card handling device can take on a number of forms useful for shuffling, card verification, card delivery and/or card storage, one preferred form of the invention is a dealing shoe incorporating a novel card reading system.

Example 1

Figure 1:
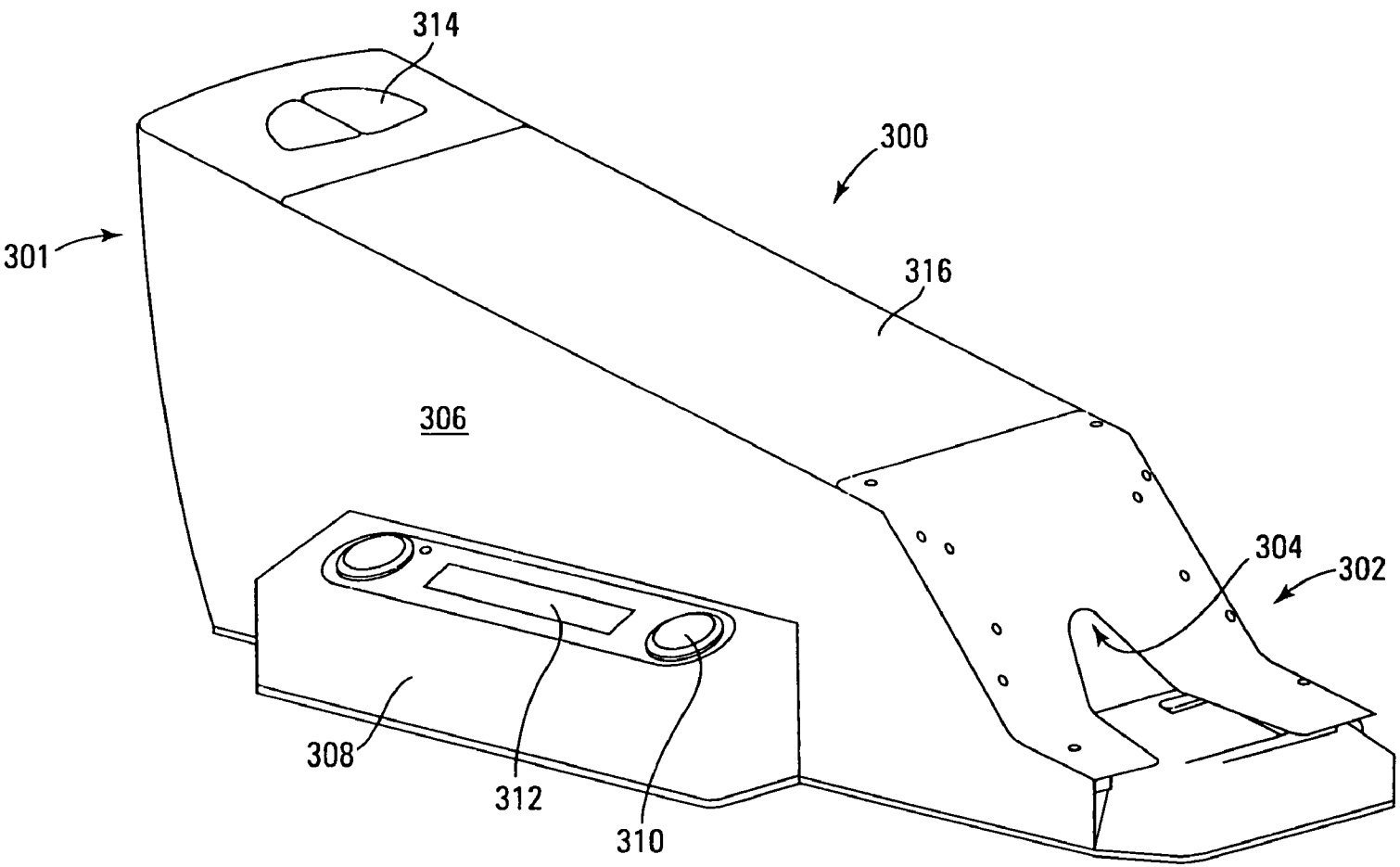
FIG. 1 is a perspective view of an example of a shoe that includes a CIS scanner and card feed limiter.

In a first example of the invention, a dealing shoe such as the one illustrated in FIG. 1 is provided. The dealing shoe 300 has a generally rectangular shape and is sloped from the rear 301 to the front 302. The shoe can be constructed of a rigid plastic or other durable material. Cards are shuffled prior to insertion into the shoe. Cards may be inserted from above, and are manually removed by pressing downwardly on an outer surface of a card through an inverted U-shaped opening 304 in the front end 302.

On a near side 306 of the shoe is an outwardly protruding control panel 308 that contains a plurality of buttons 310 and a display 312. This control panel 308 is useful for a dealer who would use the equipment to deliver cards to a casino-style card game. The display in one example of the invention is a LED display and displays a variety of information to the dealer, such as banker and player hand composition, game outcome, jam detection, cut card presence, the presence of a card from an unauthorized deck, the presence of a card from an unauthorized casino, a marked card, and the like.

Figure 2:
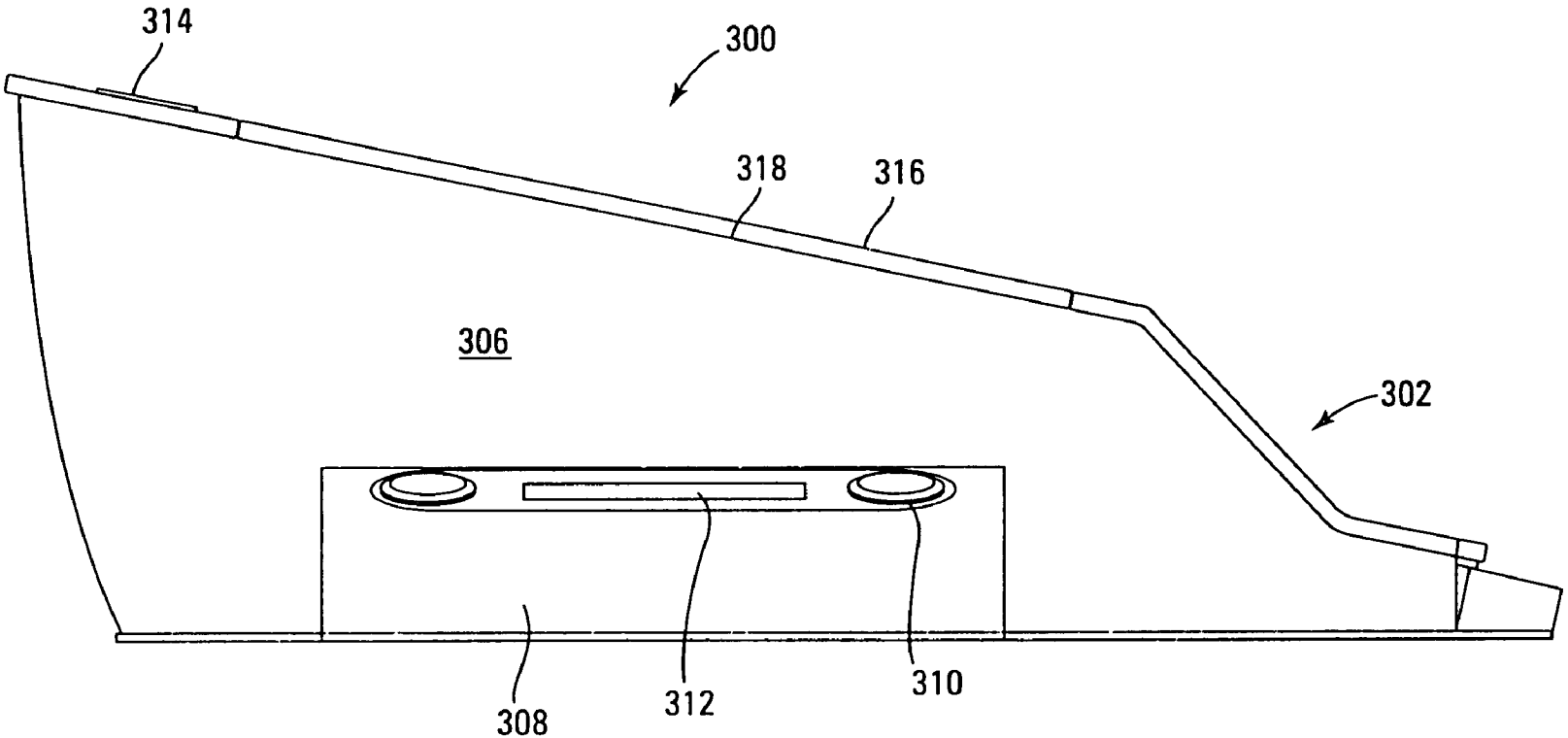
FIG. 2 is a side elevational view of the shoe.

An upper surface of the shoe contains additional controls 314. The controls 314 may additionally be backlit to convey additional information to the dealer. The shoe also contains a lid 316 which covers the cards once the cards are placed in the shoe. FIG. 2 is a side elevational view of the shoe, showing the same features in more detail. The cover 318 in this embodiment is removable such that newly shuffled cards may be inserted from above and or removed. In other embodiments of the invention, a rigid cover is provided and cards are loaded from a side of the shoe opposite the exit end.

Figure 3:
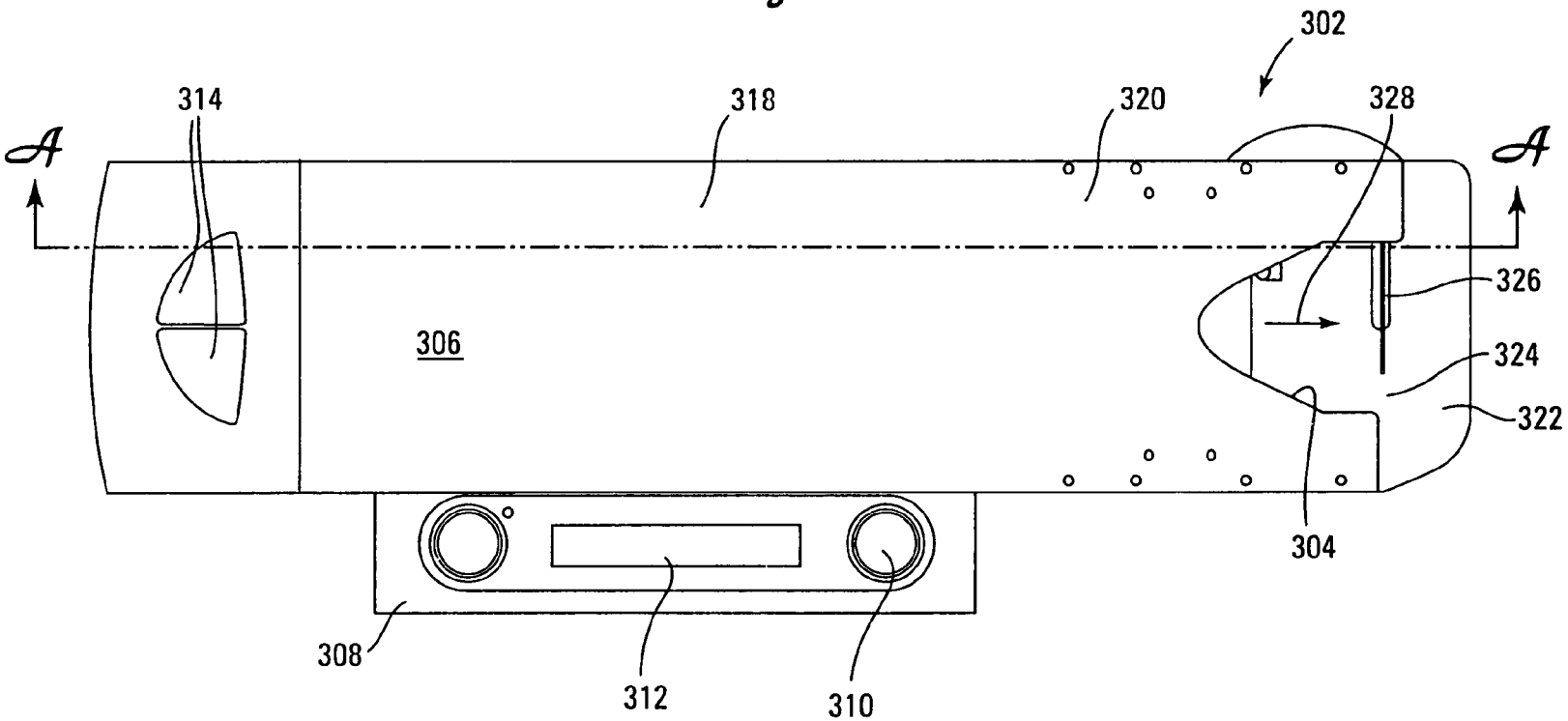
FIG. 3 is a top plan view of the simple shoe, showing the location of the CIS scanner proximate a card removal end of the shoe.

FIG. 3 is a top plan view of an example of a dealing shoe of the present invention. The front end is comprised of a top plate 320 bearing the inverted U-shaped opening 304, as is typical of a conventional dealing shoe. The plate 320 slopes downwardly and is substantially parallel at a lower end to a lower base plate 322 at the card exit 324. A CIS line sensor 326 is positioned within the base plate 322 perpendicular to a direction of travel 328 of the card exiting the shoe.

Figure 4:
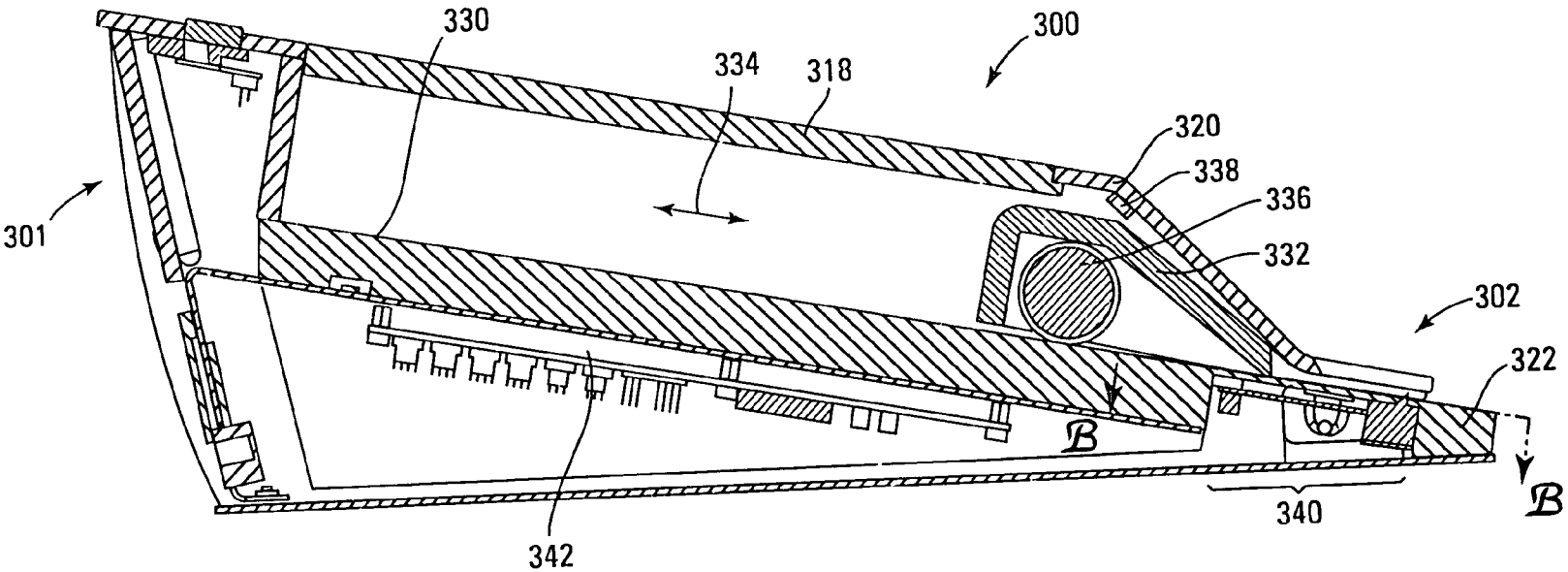
FIG. 4 is a side cross-sectional view taken along line A-A as shown in FIG. 2.

FIG. 4 is a side cross-sectional view of an exemplary shoe, taken along line A-A as shown in FIG. 3. The shoe 300 has a declining card support surface 330 for supporting a plurality of cards, positioned in a stacked relationship with long edges in contact with the card support surface 330. A movable sliding block 332 travels along a path shown as arrow 334 within the shoe. The sliding block 332 is positioned between the cards and a rear wall of the shoe, and functions to force the cards towards the exit opening. A rotatable wheel 336 reduces frictional contact between the block 332 and the declining surface 330, allowing the weight of the block to urge the cards present (not shown) to press against an inside surface of the front plate 320. A card stop 338 prevents cards being urged upwardly along the inside surface of front plate 320.

Support plate 322 serves a number of functions. Near the front end 302 of the machine, the support plate 322 houses the card sensing devices 340 and associated circuitry, as will be discussed in more detail below, and a game control board 342.

Figure 5:
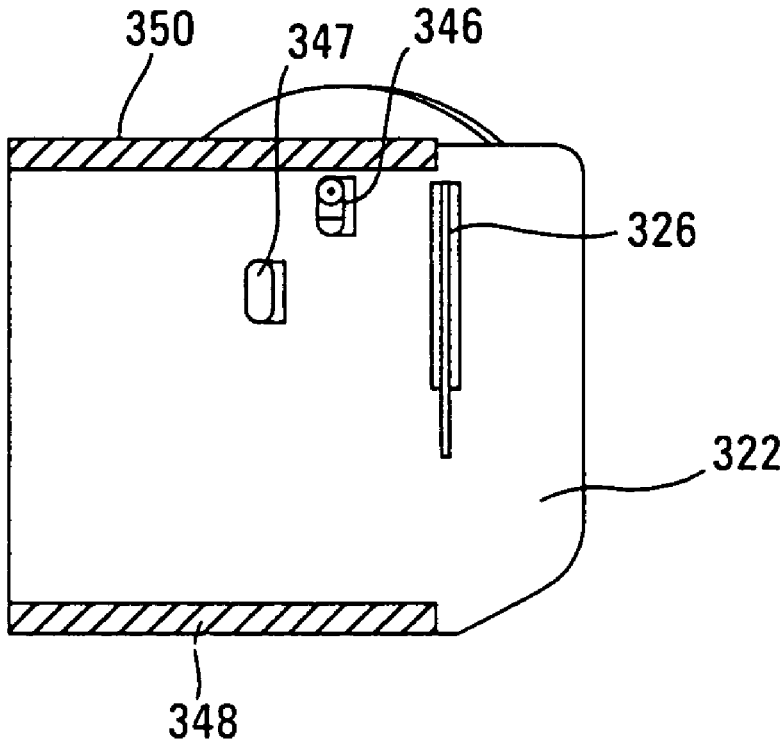
FIG. 5 is an expanded view of the card removal end, with an upper cover removed.

A top plan view of the front end of support plate 322 (with the cover 320 removed) is shown in FIG. 5. Support plate 322 has a longitudinal recess containing contact image sensor 326. A position sensor 346 is also provided in the support plate spaced slightly from the contact image sensor. A leading edge of a card being removed will pass over position sensor 346 before that same leading edge reaches CIS sensor 326. When this sensor 346 senses that a card is present, and that the card has advanced a defined amount, the CIS sensor is triggered to scan the card. Additionally, a shoe empty sensor 348 is provided in the support plate 322 to sense when the shoe is empty. A signal may be generated by the shoe empty sensor that causes the internal processor to display an "empty shoe" signal on the dealing shoe display.

Figure 6:
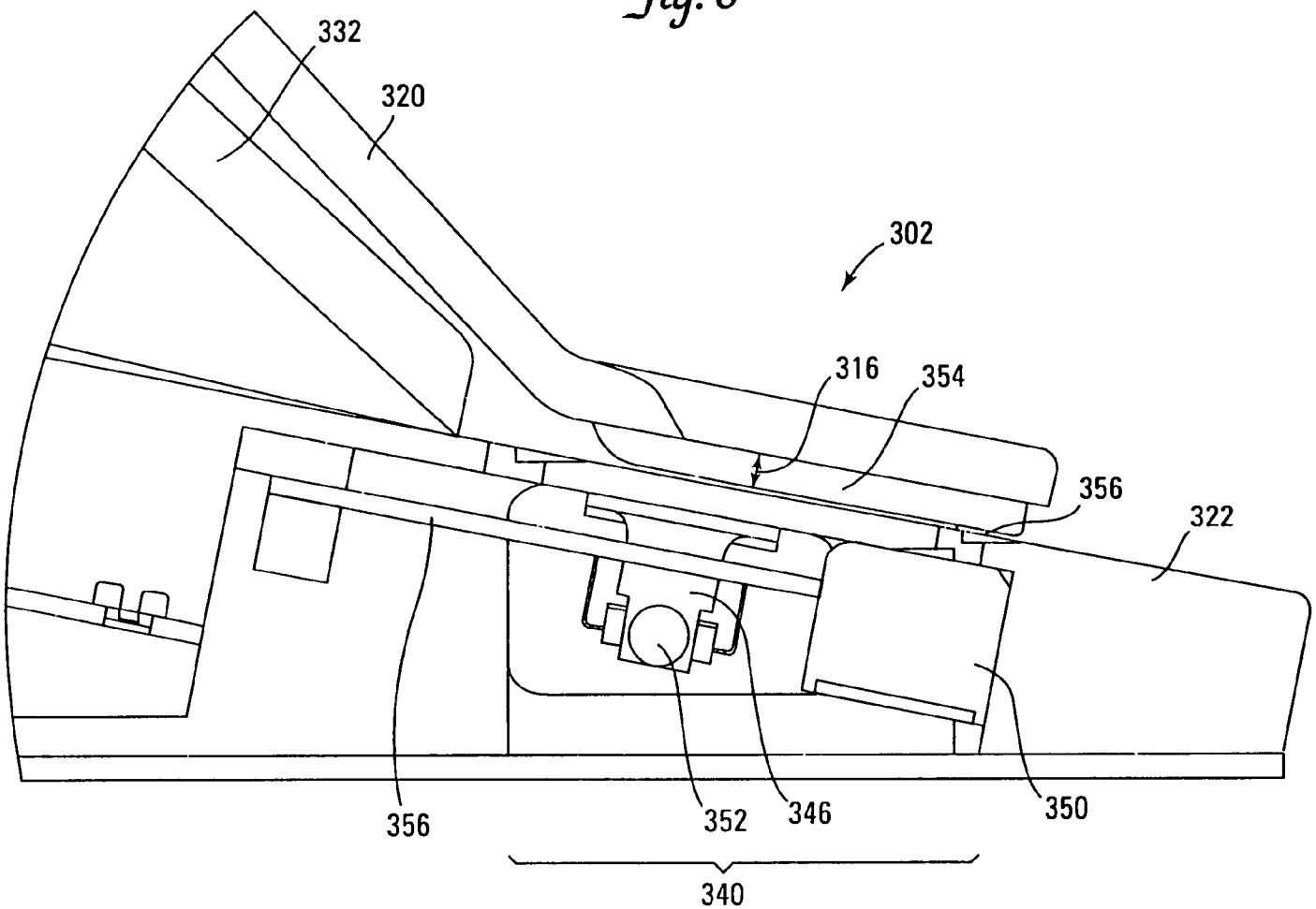
FIG. 6 is an expanded view of the card removal end of the shoe, as shown in FIG. 4.

An expanded view of the front end 332 of the shoe along line A-A from FIG. 3 is shown in FIG. 6. As shown in this Figure, all of the sensing elements are contained within area 340. A CIS sensing module 350 is located within a recess in support plate 322, as well as the position sensor 346 with associated diode 352. The position sensor 346 is in communication with associated position sensing circuit board 356.

One aspect of this example of the invention is that a card feed limiter 354 is positioned beneath the upper plate 320, near the exit end 302 of the shoe. The function of the feed limiter 354 is to prevent more than one card from exiting the shoe at a time, and to bring the card into close proximity to the CIS sensing array 350 such that the accuracy of the data acquired from the scan is maximized. Since the CIS (contact image sensor) typically needs to be in contact with the surface being scanned, the card face must either contact or nearly contact the sensor during scanning. In one example of the invention, the card feed limiter 354 narrows the gap in which cards pass to a thickness of slightly greater than the thickness of the card, but is less than the thickness of two cards. In another form of the invention, the card feed limiter 354 can be adjusted in a direction represented by arrow 358 in order to account for different card thicknesses. A typical card thickness (paper cards) is between about approximately 0.010 and 0.040 inches, and an appropriate gap width would be approximately 0.005 inch greater than the thickness of the card . . . .

In another form of the invention, a mechanized shoe is provided for use in the play of certain casino table games, especially blackjack (or Twenty-One). The mechanized shoe provides a variety of functions without greatly increasing the space on the casino table top used by the non-mechanized dealing shoe described above. The shoe provides cards securely to a delivery area and can read the cards in one or more various positions within the shoe, including, but not exclusively a) as they are withdrawn, b) before they are actually nested in the card delivery area, or c) when they are first nested in the card delivery area. A CIS sensing module would preferably be located near an exit end 36 of the shoe to read cards as they are manually removed, but can be located in other areas within the shoe. Specifically, a CIS sensor can be used to read cards in a stationary position within the shoe.

Collected card reading information is either stored and processed locally or transferred to a central computer for storage and/or evaluation. The cards may be, but are not required to be mechanically transferred from a point of entry into the dealing shoe to the card delivery area, with a buffer area in the path where at least some cards are actually held for a period of time. With the improved methodology of reading provided in the present technology, advantages are provided even in completely manually delivered shoes with the reading technology described herein. In the mechanically driven mode, the cards are preferably read before they are delivered into the card delivery area, such as at point 37 in FIG. 7.

One aspect of technology that is beneficial to all card reading systems that is not known to have been provided before is the use of spaced line scans. Previous systems that read conventional playing cards without special markings or machine readable codes thereon have basically taken full images of the rank and suit indicia (e.g., 2, 3, 4, 5, 6, 7, 8, 9, 10, J, Q, K or A and ♠, ♡, ◇or ♣, respectively), and the entire image was compared to prerecorded or stored images to determine the rank and suit. This required significant data carrying and more computing power than should have been needed, and also could allow for little tolerance in the comparison of images. As is described herein, only spaced line scans need be used in detecting suit and rank from scanning of the normal suit and rank indicators on playing cards. Multiple well positioned line scans on the suit symbols can absolutely distinguish among the four suits, and multiple well-positioned symbols can also distinguish among all 13 of the rank symbols. It is therefore feasible to provide an accurate reading of suit and rank symbols with line scans, rather than scanning the entire suit symbol and the entire rank symbol. Although just a few line scans per symbol can theoretically provide an accurate identification of suit and rank, greater numbers of spaced line scans (for example, between 2 and 10) are used in practice to insure the accuracy of the rank and suit identification.

Spaced line scan data may be compared with stored data of lines scans of known suit and rank symbols. Alternatively, the spaced line scans may actually be used to provide signals indicative of the properties or attributes of the individual line scans. The signals from the scans may be used by either a hardware component such as a data transformer (e.g., ASIC or FPGA) to transform the signal to data or by a processor to process the signal into useful information or data. An ASIC is Application-Specific Integrated Circuit, a chip designed for a particular application (as opposed to the integrated circuits that control functions such as RAM in a PC). ASIC circuits are very costly to produce and are appropriate only for large scale production. One advantage of using a FPGA's is that they are built by connecting existing circuit building blocks in new ways. Since the building blocks already exist in a library, it is much easier to produce a new FPGA than it is to design a new chip from scratch.

FPGAs are field programmable gated arrays, which are a type of logic chip that can be configured for a specific application. An FPGA is similar to a programmable logic device (PLD), but whereas PLDs are generally limited to hundreds of gates, FPGAs support thousands of gates. They are especially popular for prototyping integrated circuit designs. Once the design is set, hardwired ASIC chips are produced to replace the FPGA's for faster performance.

The data fed into the hardware component is received directly from the CIS scanner. The following is an explanation of how the signal is conditioned in the hardware component.

The output of the scan is voltage. The voltage relates to the intensity of the light reflected from the scanned, illuminated image. Within one line scan, multiple voltages will be outputted, depending on the light intensity in each of a number of discrete scanned areas. One area typically is approximately 7 pixels in length. The various voltages (vs. Y distance along the line scan) are converted into binary values.

Looking at the four suit symbols (and scanning the symbols along lines spaced in the X direction, extending from the top to the bottom of the image or in the Y direction in this example) certain attributes can be produced only by individual symbols or subgroups of the following symbols: ♠ ♡ ♢ ♣

The spade and club can provide attributes of dense markings in the X direction approximately ⅔ from the top of the scan, extending across the entire width of the character. Only the heart has dense markings across the top edge. Only the diamond has a maximum width about 50% of the distance from the top of the character. The heart and diamond have the least density at a lower most edge of each character. By determining attributes of the images being scanned, and in the sequence in which they are taken from the playing cards, the suit and rank can be readily determined with little to no computing power. It should also be remembered that in conventional playing cards, the rank symbols (2, 3, 4, 5, 6, 7, 8, 9, 10, J, Q and K) read across the short side of the card, and that the rank and suit are positioned on a vertical line parallel to the long side of the card, in a corner area. The suit symbol always appears beneath the rank symbol. Thus, the line scan in the corner edge regions taken by the scanner/imager/camera will always know that the portion of the line scans nearest the short side (top) of the card represents the rank. Likewise, the portion of the scan farther away from the short side of the card represents the suit. If a trailing edge of the card, or even if the entire card or other sections of the cards are instead or additionally read, the order of the suit and rank symbols will be known in advance and the scans applied (by hardware or software, or both, as indicated above) to determine the suit and rank of each card. Because spaced line scans are used (a spaced line scan is sets of at least two line scans wherein there is at least a space between lines scanned that is at least as thick as the scan dimension of a line itself), less than 50% of the symbol area may actually be scanned. The speed of the card moving across the scanner may also vary significantly, without having any detrimental effect on the certainty of the suit and rank identification. Because attributes or combinations of line scans in sequence may be used to determine the suit and rank, the precise position, shape and size of the image is not essential. For example, a card may get skewed by hand movement of the card, different speed, and rotational action on the cards by a dealer's hand, causing misalignment.

The image capture system may be any imaging device or system that can provide line data or line images, preferably continuous line data or images, and provide those line data or images on demand. A preferred system is the contact image sensor (CIS) which is a type of optical flatbed scanner that does not use the traditional 2-dimensional CCD arrays that rely on a system of mirrors and lenses to project the scanned image onto the arrays. CIS scanners gather reflected light from monochromatic sources such as red, green and blue LEDs (which combine to provide white light) and direct the light at the original document being scanned. Although monochromatic light sources are preferred, with green light being a more preferred light source, white light can also be used with most playing cards made in the United States. When the red ink used to print the card is a true red and does not contain any black pigment, the white light source is less preferred than a monochromatic light source. A color sensitive CIS is not required, as black-and-white images of the line scans are sufficient to identify suits and rank, which are typically printed with black and red (or maroon or red/black) ink. The light that is reflected from the original image is gathered by a lens and directed at a line sensor that rests just under the document being scanned. The sensor then outputs a series of voltages corresponding to the intensity of light that hits each individual sensing segment within the line sensor. A CIS scanner is more compact than a CCD camera and can be used in smaller products than CCD scanning technologies. Cameras typically require longer focal lengths in order to capture an image. CIS line scanners in contrast are capable of capturing data when the object being scanned is in contact with the scanner. CIS scanners also require less power than CCD cameras and often can run off battery power or the power from a USB port. CCD cameras, however, provide higher-resolution scans. Although a focal length (from a sensing lens to the object being sensed) varies by manufacturer, it is desirable for the object to either come into contact with or come within a few millimeters of the scanner for optimal performance.

As previously mentioned, a preferred CIS line scanner is a black and white scanner. It has been demonstrated that using a monochromatic light source, such as a green or blue LED light, the quality of each line scan is improved when this type of scanner is used. If a color scanner was used instead, a white light source would be sufficient. The function of the monochromatic light source is to make the red, maroon or red/black images on the cards appear black to the scanner. In one form of the invention, a green light source having a peak wavelength of 520 nanometers is used for this purpose. In another form of the invention, a blue light source having a peak wavelength of 475 nanometers is used for this purpose. Such light sources actually produce a wavelength band of light, but the band width is relatively narrow.

The inventors have noted that known manual shoes prior to the present invention suffered from card-reading inaccuracy resulting from the variability in the efforts of the dealer to remove cards from the shoe. The force applied by different dealers can vary significantly. Significant variations in force can cause more than a single card to be removed from the dealing shoe at the same time, causing a miscount in the number of cards delivered, and resulting in an extra card being delivered to the game that is not accounted for by the system. Although this may be only an annoyance in traditional dealing shoes, the impact is far more significant and deleterious in the operation of a dealing shoe used for the purpose of monitoring the composition of each card that is in play on the table. Game play monitoring equipment must necessarily maintain accurate card count and card identification information.

An intelligent dealing shoe is defined as a shoe in which information is taken (scanned, read or imaged) from the playing card as the playing card is either positioned within the shoe or is withdrawn from the shoe. As dealing shoes are generally constructed so as to read only one face of the card (e.g., usually the face with the playing card symbols and rank displayed thereon), pulling more than a single card out at the same time blocks or masks the images on the upper card. When a card-reading shoe is part of a larger game play monitoring system, any card that is moved without being counted and/or read poses a security problem. As the card reading is an essential benefit to a smart system, providing accurate records of the cards played, and being essential for the verification of sets of cards being handled and/or shuffled, hands of cards and decks of cards, the failure to identify or see a card could cause an entire deal, an entire deck or multiple decks of cards grouped together to be identified as faulty. This would lead to delays, complaints and most importantly, loss of income to the casinos.

One additional technology provided to dealing shoes by the present disclosure is the placement of at least one card limiting barrier on or recessed within an interior surface of an exit plate on an intelligent playing card delivery shoe. The term "manual playing card delivery shoe" or "manual shoe" for purposes of this disclosure means a shoe structure that requires that cards be manually pulled out of an exit hole or finger accessible hole on the delivery end. The term "intelligent" means (in the practice of this invention, but not generally in the art) that a reader, imager or scanner detects the suit and/or rank of a playing card as it is being withdrawn from the delivery shoe. The shoe may have motorized internal movement of cards and may deliver cards mechanically to the delivery port, but then the cards are individually pulled out by hand.

Example 2

Figure 7:
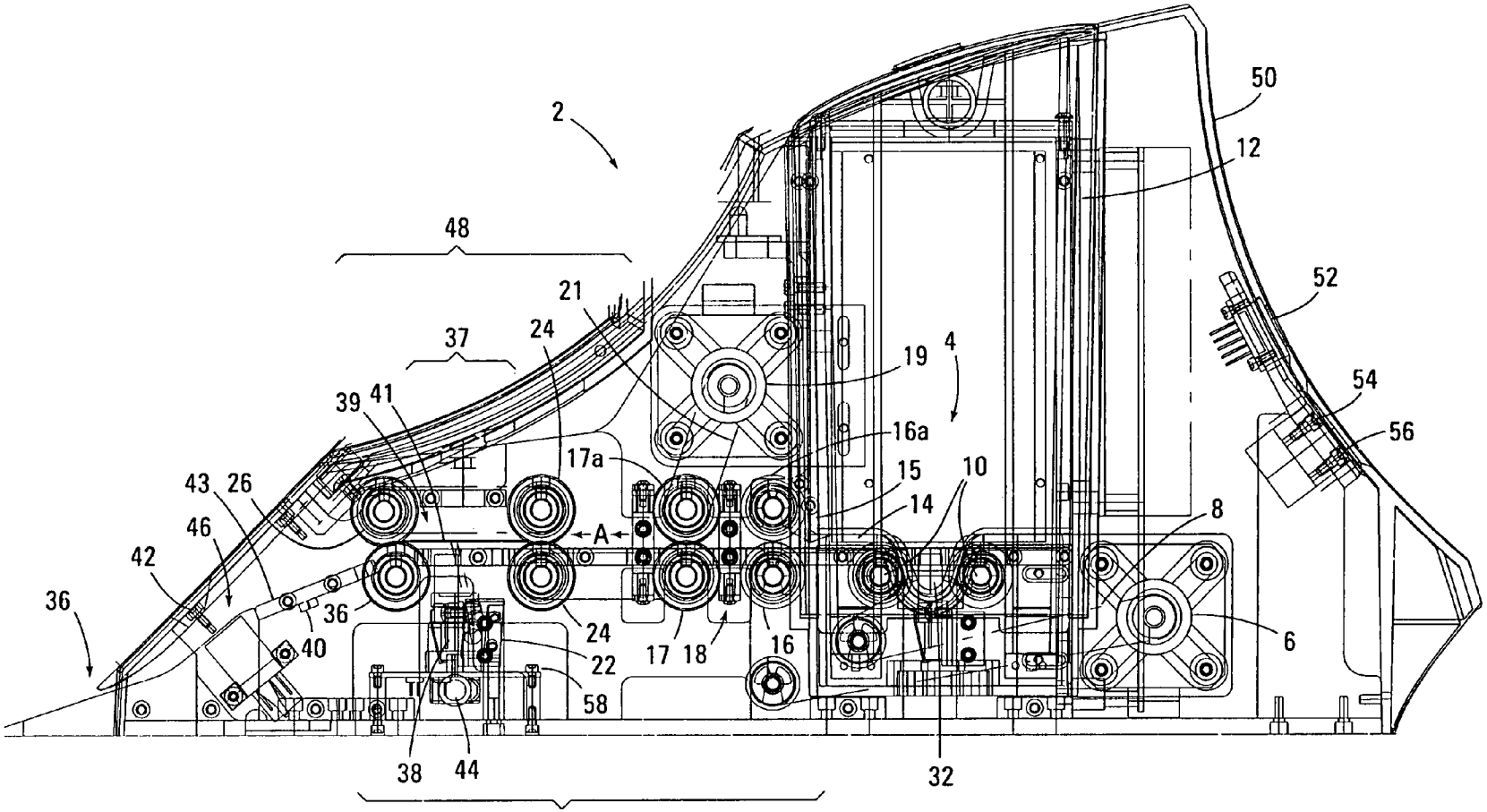
FIG. 7 shows a cutaway view of the side of a mechanized dealing shoe according to the invention.

Reference to the remaining Figures will help in an appreciation of the nature and structure of a second embodiment of the card delivery shoe of the invention that is within the generic practice of the claims and enables practice of the claims in this application. FIG. 7 shows a mechanized card delivery shoe 2 according to the present invention. The card delivery shoe 2 has a card infeed or card input area 4 which is between a belt driving motor 6 and the motor 19 of speed up roller 17*a*. The belt driving motor 6 drives a belt 8 that engages pick off rollers 10. These pick off rollers 10 pick off and move individual cards from within the card infeed area 4. A belt driving motor 6 is shown but other motor types such as gear drives, axel drives, magnetic drives and the like may be alternatively used. The pick off rollers 10 drive individual playing cards (not shown) into gap 14 having a deflector plate 15 to direct cards individually through the gap 14 to engage brake rollers 16. The brake rollers 16 control the movement of individual cards from the infeed area 4 into the card staging area 34. The braking rollers 16 are capable of becoming free-turning rollers during a card jam recovery process so that little or no tension is placed on a card as it is being moved by the system or manually to free a jam. A simple gear release or clutch release can affect this function. Speed up rollers 17 apply tension to a card to move it more deeply into the card staging area 34. The speed up rollers can and may turn faster then the braking rollers 16, and the speed up rollers 17 may be driven by a separate motor 19 and belt drive 21. A card path and direction of movement A is shown through the card storage area 34. As individual cards are passed along the card path A through the card storage area 34, there are card presence sensors 18, 20, and 22 located at various intervals and positions to detect the presence of cards to assure passage of cards and/or to detect stalled or jammed cards. The path A through the card storage area 34 is in part defined by speed-up rollers 17 or rear guide rollers 24 and forward guide rollers 26 which follow the brake rollers 16 and the speed up rollers 17. One form of a buffer area 48 is established by the storing of cards along card path A. As cards are withdrawn from the delivery end 36 of the delivery shoe 2, additional cards are individually fed from the buffer area 48 into the card feed chute 46 and then into the delivery end 36. As noted earlier, the mechanized delivery shoe is preferred, but a shoe with no driven parts, such as the shoe described in the first example of the invention may be provided with the imager described herein and the signals provided therefrom sent to hardware that transforms the signals, software that processes the signals, intermediate storage systems and/or final storage systems for use at appropriate times. The description will emphasize the delivery shoe (which may also be the output element of a shuffler) that automatically moves and delivers cards, only because that is a preferred embodiment, not because that is the only format of shoe that can be used with the described imaging technology.

It is always possible for cards to jam, misalign or stick during internal movement of cards through the dealing shoe. There are a number of mechanisms that can be used to effect jam recovery. The jam recovery may be based upon an identified (sensed) position of am or may be an automated sequence of events. Where a card jam recovery is specifically identified by the sensed position of a jammed card in the device (and even the number of cards jammed may be estimated by the dimensions of the sensed image), a jam recovery procedure may be initiated at that specific location. A specific location in FIG. 1 within the dealing shoe (e.g., between and inclusive of rollers 16 and 17 will be discussed from an exemplary perspective, but the discussion relates to all other positions within the device.

If a card is sensed (e.g., by sensors 18 and/or 20) as jammed between rollers 16 and 17 (e.g., a jam occurs when cards will not move out of the position between the rollers and cards refuse to be fed into that area), one of a various number of procedures may be initiated to recover or remove the jam. Among the various procedures which are discussed by way of non-limiting examples include at least the following. The rear-most set of rollers (16 and 16*a*) may reverse direction (e.g., 16 begins to turn clockwise and 16*a* begins to turn counterclockwise) to remove the jammed card from between the rollers (16 and 16*a*) and have the card extend backwards into the space 14, without attempting to reinsert a card into the stacking area 4. The reversed rotation may be limited to assure that the card remains in contact with the rollers 16 and 16*a*, so that the card can be moved back into progression through the dealing shoe. An optional part of this reversal can include allowing rollers 17 and 17*a* to become free rolling to release contact and tension on the card during the reversal. The reversed rotation may be smoothly run or episodic, attempting to jerk a jammed card from its jam position. If that procedure does not work or as an alternative procedure, both sets of rollers 16 and 17 may reverse at the same time or in either sequence (e.g., 16 first or 17 first) to attempt to free the jam of a card. When one set of rollers only is turning, it is likely to be desirable to have the other set of rollers in the area of the jam to become free rolling. It is also possible to have the rollers automatically spaced further apart (e.g., by separating roller pairs to increase the gap in the potential nip between rollers) to relieve tension on a card and to facilitate its recovery from a jam. The adjacent pairs of rollers (e.g., 16, 16*a* and 17, 17*a*) can act in coordination, in sequence, in tandem, in order, independently or in any predefined manner. For example, referring to the roller sets as 16 and 17, the recovery process may have the rollers act as a) (16-17) at the same time in the same direction), b) (16-17) at the same time in the opposite directions to assist in straightening out cards, c) (16 then 17) to have the rollers work sequentially, d) (17 then 16) to have the rollers work in a different sequence, e) 16 only for an extended time, and then 17 operating alone or together with 16, f) 17 only for an extended time or extended number of individual attempts and then 16 for a prescribed time, etc. As noted earlier, a non-active or driven roller (one that is not attempting to drive or align cards) may become free-rolling during operation of another roller.

These various programs may be performed at a single jam location in series or only a single program for jam recovery may be affected. In addition, as the card may have been read at the point of the jam or before the jam, the rank and value of the card jammed may be identified and this can be displayed on the display panel on the dealing shoe, on the central computer or on a shuffler connected to the dealing shoe, and the dealer or pit boss may examine that specific card to make certain that no markings or damage has occurred on that card which could either cause further problems with the dealing shoe or shuffler or could enable the card to be identified when it is in the dealing position in the shoe at a later time. The pit crew can then correct any problem by replacement of that specific card, which would minimize down time at the card table. Also, if a jam cannot be recovered, the delivery shoe would indicate a jam recovery failure (e.g., by a special light or alphanumeric display) and pit personnel would open the device and remove the jam manually.

Individual playing cards (not shown) may be read at one or more various locations within the card delivery shoe 2. The ability to provide multiple read locations assures performance of the shoe, while other card delivery trays with read capability usually had a single reading position at the point where and when cards were removed from the shoe for delivery to players. For example, in the construction shown in FIG. 1, the card presence sensors 18, 20 and 22 may also have card reading capabilities, and other card reading sensors may be present as elements 32, 40 and 42. Element 38 may be optionally present as another sensing element or a card value (and possibly suit) reading element without the presence of sensor 22 or in combination with sensor 22. In one form of the invention, when the sensor 38 functions as a card reading element, it should read the cards as they are positioned into the card pre-delivery area or card buffer area 37. In another example of the invention, cards are read for example by a CIS sensor array and card present sensor as they are removed from the card delivery end 36. Information may be read in the first example by the card reading sensor 38 by either continuous reading of all image data in the card pre-delivery area or by triggered on-off imaging of data in a specific region of cards 39 as a card 41 is within the pre-delivery area 37. For example, card presence sensor 22 may activate sensor 38. This sensor in one example is a camera. A light source (not shown) may be provided to enhance the signal to the sensor 38. If the camera is a black and white camera, it might be desirable to use a filtered light source, such as a green or blue light source to improve the imaging of red or red/black indicia on the cards. That specific region of cards is preferably a corner of the card 41 wherein complete value information (and possibly suit information) is readable on the card, such as a corner with value and suit ranging symbols on the card. That region could also be the entire face of the card, or at lease ½ of the card (lengthwise divided). By increasing the area of the region read more processing and memory is required, but accuracy is also increased. Accuracy could alternatively be increased, by providing some redundancy. For example, reading the underside of the upper right hand corner of the card and then an underside of the lower left hand corner could be done, since both of those locations contain the rank and suit of the card. By reading 2 locations on the card, readings can be compared and then confirmed. By using on-off or single shot imaging of each card 41, the data flow from the sensor/card reading element 38 is minimized and the need for larger memory and data transmission capability is reduced in the system. Information may be transferred from the card reading elements (e.g., 32) from a communication port or wire 44 shown for sensor/reading element 32. Cards may be buffered or staged at various points within the dealing shoe 2, such as where restrained by rollers 26 so that cards partially extend towards the chute 46 past the rollers 28 on plate 43, or staged between rollers 24 and 26, between rollers 17 and 24, between rollers 16 and 17 and the like. Cards may partially overlap in buffering as long as two or more cards are not present between a single set of nip rollers (e.g., 26 and 27) where nip forces may drive both cards forward at the same time.

Other variations are available and within the skill of the artisan. For example, rear panel 12 may have a display panel thereon for displaying information or data, particularly to the dealer (which information would be shielded from players as the rear panel 12 would primarily face the dealer and be shielded from players' view. A more ergonomic and aesthetic rear surface 50 is shown having a display 52 that is capably of providing alphanumeric (letters and numbers) or analog or digital images of shapes and figures in black-and-white or color. For example, the display may give messages as to the state of the shoe, time to number of cards dealt, the number of deals left before a cut card or virtual cut card is reached (e.g., the dealing shoe identifies that two decks are present, makes a virtual cut at 60 cards, and based on data input of the number of players at the table, identifies when the next deal will be the last deal with the cards in the shoe), identify any problems with the shoe (e.g., low power, card jam, where a card is jammed, misalignment of cards by rollers, and failed element such as a sensor), player hands, card rank/suit dispensed, and the like. Also on the rear surface 50 are two lights 54 and 56, which are used to show that the shoe is ready for dealing (e.g., 54 is a green light) or that there is a problem with the dealing capability of the shoe (e.g., 56 is a red light). The memory board 58 for the card reading sensor 38 is shown with its information outlet or port 44 shown.

There are significant technical and ergonomic advantages to the present structure. By having the card infeed area 4 provide the cards in at least a relatively vertical stack (e.g., with less then a 60° slope of the edges of the cards away from horizontal), length of the delivery shoe 2 is reduced to enable the motor driven delivery and reading capability of the shoe in a moderate space. No other card delivery shoes are known to combine vertical card infeed, horizontal (or approximately horizontal ±40° slope or ±30° slope away from horizontal) card movement from the infeed area to the delivery area, with mechanized delivery between infeed and delivery. The motor drive feed from the vertical infeed also reduces the need for dealers to have to jiggle the card tray to keep cards from jamming, slipping to undesirable angles on the chutes, and otherwise having to manually adjust the infeed cards, which can lead to card spillage or exposure as well as delaying the game.

Example 3

Figure 8:
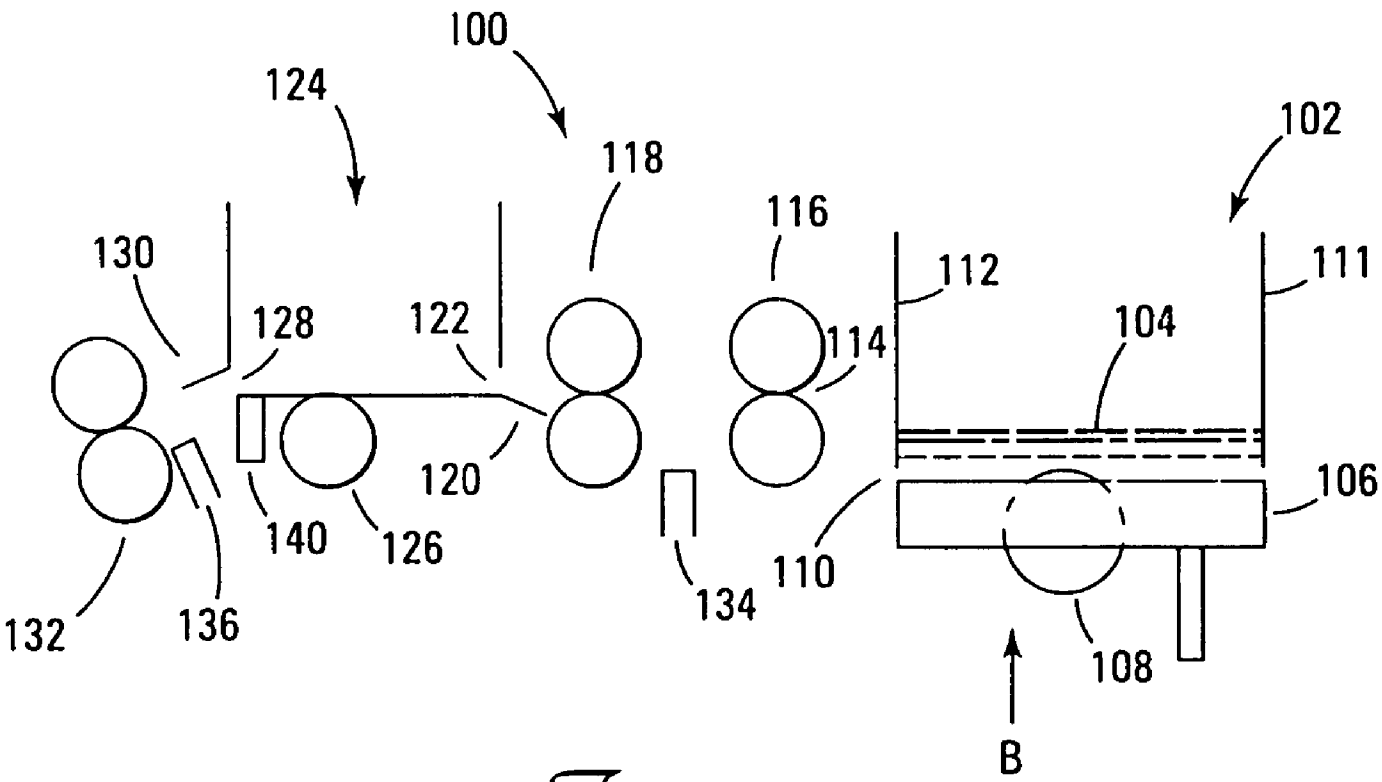
FIG. 8 shows a schematic section of the dealing shoe having alternate card reading and buffer areas.

FIG. 8 shows a schematic diagram of an alternate embodiment for internal card buffering and card moving elements of the card delivery tray 100. A card infeed area 102 is provided for cards 104 that sit between walls 111 and 112 on elevator or stationary plate 106 which moves vertically along path B. A pick-off roller 108 drives cards one-at-a-time from the bottom of the stack of cards 104 through opening 110 which is spaced to allow only one card at a time to pass through the hole 110. Elevator 106 is raised (moving in the direction represented by arrow B) such that a bottom card on the upper surface is aligned horizontally with speed control roller pair 116. The individual cards are fed horizontally into the nip area 114 of the first speed control or guide rollers 116 and then into the second set of speed control or guide rollers 118. The cards (one-at-a-time) passing through rollers 118 are shown to deflect against plate 120 so that cards flare up as they pass into opening 122 and will overlay any cards (not shown) in card buffer area 124. A second pick-off roller 126 is shown within the buffer area 124 to drive cards one-at-a-time through opening 128. The individual cards are again deflected by a plate 130 to pass into guide rollers 132 which propels the cards into the delivery area (not shown) similar to the delivery area 36 in FIG. 1. Card reading elements may be positioned at any convenient point within the card delivery element 100 shown in FIG. 2, with card reading elements 134 and 136 shown as exemplary convenient locations.

Figure 9:
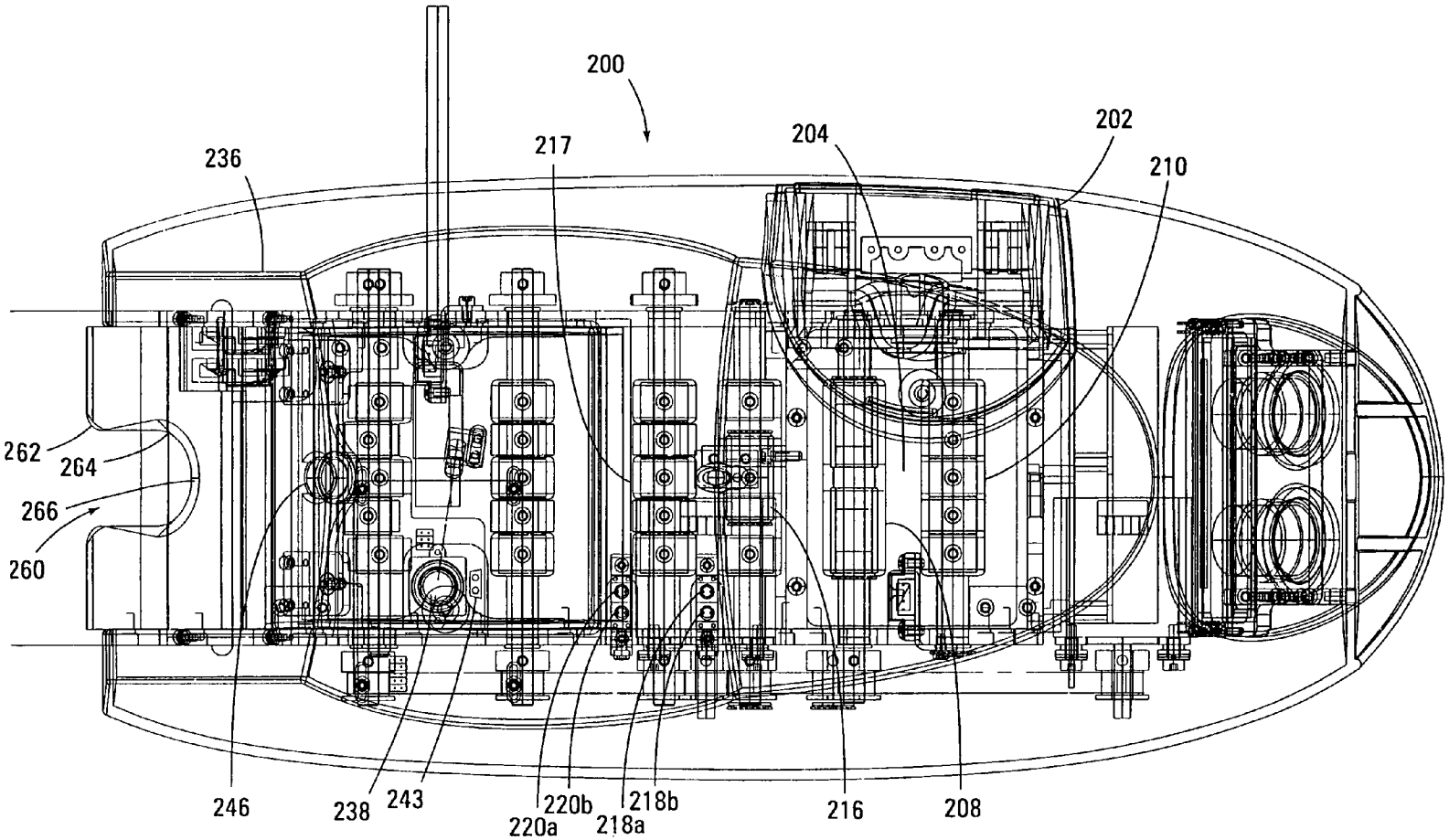
FIG. 9 shows a top cutaway view of one embodiment of a dealing shoe of FIG. 7 according to the present invention.

FIG. 9 shows a top cutaway view of the mechanized dealing shoe 200 of the second example of the present invention. A flip up door 202 allows cards to be manually inserted into the card input area 204. The sets of pick-off rollers 208 and 210 are shown in the card input area 204. The position of the sensors 218*a* and 218*b* and 220*a* and 220*b* are shown outwardly from the sets of five brake rollers 216 and five speed up rollers 217. The sensors are shown in sets of two sensors, which is an optional construction and single sensors may be used. The dual set of sensors (as in 220*a* and 220*b*) are provided with the outermost sensor 220*b* providing simply sensing card presence ability and the inner innermost sensor 220*a* reads the presence of card to trigger the operation of the camera card reading sensor 238 that reads at least value, and optionally rank, and suit of cards. The sensor 220*a* alternatively may be a single sensor used as a trigger to time the image sensing or card reading performed by camera 238 as well as sensing the presence of a card. An LED light panel 243 or other light providing system is shown present as a clearly optional feature. A sensor 246 at the card removal end 236 of the shoe 200 is provided. The finger slot 260 is shown at the card delivery area 236 of the shoe 200. The lowest portion 262 of the finger slot 260 is narrower then the top portion 264 of the finger slot. The walls 266 of the finger slot may also be sloped inwardly to the shoe and outwardly towards the opening 260 to provide an ergonomic feature to the finger slot 260. A CIS sensing array (not shown) may be alternatively positioned within the shoe or near the exit end of the shoe.

Figure 10B:
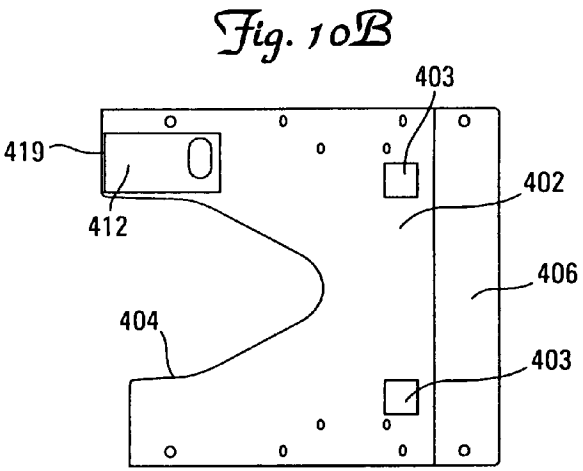
FIGS. 10A-D show various views of the interior face of an exit plate having a card limiter attached thereto.
Figure 10D:
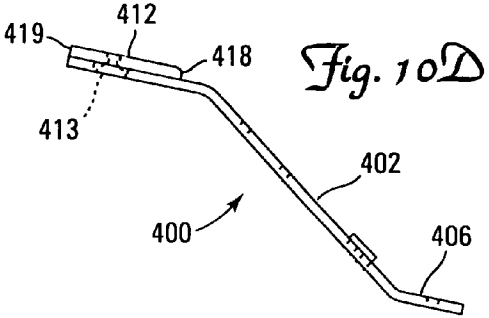

FIGS. 10A through 10D show various views of a front plate 400 that is positionable on the front or delivery end of a manual playing card delivery shoe (described in Example 1). The front plate 400 is shown with its interior face 402 (which faces the playing cards as they move through the shoe) exposed. The front plate has about three different gross features incorporated in its shape. The three features are the interior face 42, the top glide face 406 and the exit guide face 408. The top glideface 406 directs playing cards towards the downward glide area that is covered by the interior face 302. Card stops 403 prevent cards from sliding up. The interior face 402 guides the cards downward at the front of the delivery shoe towards the exit glide face 408. There is an opening 404 through which a dealer's finger(s) is positioned to manually pull playing cards downward and out of the delivery shoe. The opening extends from the interior face 402 through the exit glide face 408. It is in this last region against the front plate 400 that more than one card can be drawn out at a time, prior to the present invention. To assist in controlling the dimension of the opening between the front plate 400 and a bottom guide plate (not shown) approximately where the reading/imaging system is located (shown in FIG. 4), at least one (one is shown) physical partial barrier 412 is provided. The barrier restricts the pathway between front plate 400 and the support surface (not shown) in the delivery shoe. The physical partial barriers assist in defining the pathway to a dimension that can be controlled to minimally exceed the thickness of a single playing card. For example, a card thickness of 0.010 to 0.014 would require another 0.005 inches for adequate clearance. By rising above the surface of the exit glide face 408, the leading edges 418 of the partial barrier 412 do not impact a leading edge of a top card being pulled through the opening 404, but merely limits the size of the opening. The limiter also advantageously brings the card face into contact or near contact with the CIS sensor. The leading edge 418 may be flat and perpendicular to the surface of the partial barrier 412, may be beveled, may be curved (as shown in FIG. 10D), or any other shape as long as the total dimension of the pathway created between the front plate 400 and a bottom guide plate (not shown) is more accurately controlled than by generic manufacture of a dealing shoe. One additional reason that generic manufacture of the dimension of the pathway allows the problem of multiple card pull-through is the fact that not all playing cards (especially from differing card manufacturers or because of humidity and swelling) have the same thickness. With an adjustable partial barrier, the pathway dimensions may be tailored for different cards, conditions and manufacturers. The partial barrier 410 may be made adjustable (either the entire plate or only the front edge 419 of the partial barrier 310) by a mechanical adjustment 413 that can be performed on the partial barrier 410. The simplest mechanical control would be a screw assembly, such as the screw shown positioned through the thickness of partial barrier 412. The rotation of the screw or bolt can elevate or lower (to a limit of the surface of the exit glide face 408) the partial barrier 412. A threaded female receptor (not shown, but merely an embedded tube or cylinder with internal threads may be embedded in the front plate 400 to securely receive the bolt or screw 413. The trailing edge 419 of the partial barrier 412 may be flat, beveled or rounded. It should be noted that it appear counterintuitive that the partial barrier is placed on the interior surface of the front plate, as the partial barrier would appear to impact the top card (the next card to be delivered) in the set of cards in the delivery shoe. In fact, the partial barrier must be on the top, as even though a barrier on the rear opposed surface would catch the second card, that second card would remain backed or caught against the partial barrier and would have to be lifted over the leading edge when that card is next to be removed from the delivery shoe. This is because the partial barrier controls the dimension of the pathway and does not necessarily impact the leading edges of cards.

Figure 10C:
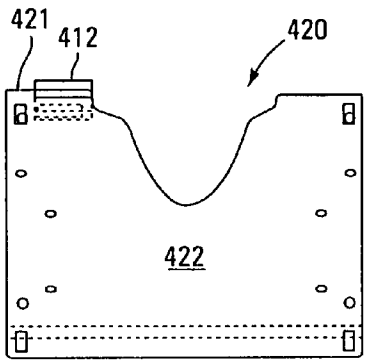
Figure 10A:
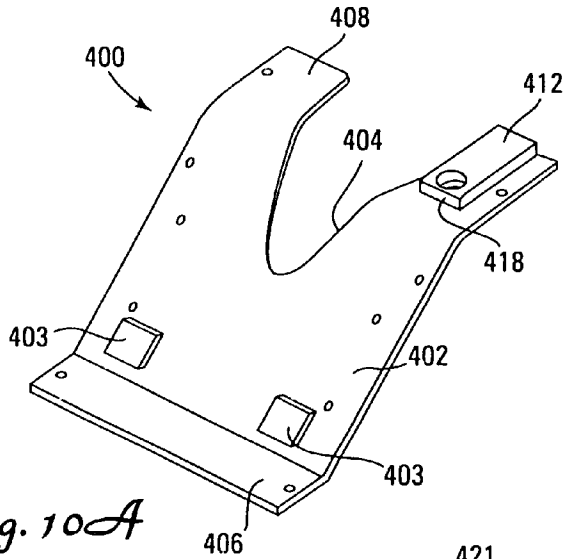

FIG. 10C illustrates another embodiment of the card feed limiter 420. The card feed limiter in this instance has a front edge that extends beyond the front edge 421 of top plate 422.

Although in the second example of the invention, a camera was disclosed for use in imaging cards, the imaging technology of the present invention also includes the use of a CIS line scanning system as illustrated in the following description, below.

The present technology also includes an apparatus for determining the identity of symbols on playing cards, typically at the point of being manually pulled through an exit chute of a dealing shoe. The shoe has a front plate with an upper interior surface and a lower support surface opposed to the upper interior surface, the support surface comprising a CIS scanner and a motion scanner to trigger the scanner, to provide signals derived from the scanning of multiple, spaced apart discrete lines bisesecting playing card symbols passed over the imager. In one form of the invention, a line scanner is used to scan spaced lines of an image. In another example of the invention, a 2D scanner (such as a CMOS array) is used to scan spaced apart lines bisecting the image. Either a number of lines of scan areas between the selected line scans comprising the CMOS array is disabled, or the data that does not comprise the selected spaced lines scans is filtered out and ignored. The use of a 2D imager would be more appropriate when the card is scanned in a stationary position. The disadvantage of such an imaging system is that the spaced scans would have to fit within the focal area of the CMOS imager. Using a moving card and a stationary line scanner (or a stationary card and a moving line scanner) provides the advantage that the image can be an infinite length in the direction of travel of the card and still be scanned by the system.

The upper interior surface of the front plate has a partial barrier for cards fixed over the interior surface. The partial barrier has an elevated surface, the elevated surface defining a height of a pathway for cards between the interior surface and the lower support surface. The CIS line scanner in a preferred form of the invention is embedded into the lower support surface, beneath the partial barrier. The partial barrier serves the dual function of preventing multiple cards from exiting the shoe at one time, and positions the portion of the card face to be scanned in close proximity to, and preferably in contact with the scanner.

The technology also includes a method of identifying the rank and suit of a playing card comprising manually pulling a playing card through a pathway having an upper plate with an interior surface to automatically take spaced line scans of rank and suit symbols on the playing card. The scanner in turn creates operating signals relating to less than all of the area of the symbols and correlating the signals with known signals to identify the rank and suit by closest correlation of the operating symbols and the known symbols, wherein a partial barrier on the interior upper plate controls a height of the pathway.

During initial development of the system, the inventors encountered a problem that affected the dependability, but not operability of the system. The scan length of the device is relatively small compared to the long dimension of the card, yet different brands of cards locate the rank and suit information different distances from the short card edge. A decision had to be made as to where best locate the small scanning area. Since the location/size of the card rank and suit is not the same from brand to brand of cards, and since cards do not always align themselves with the scanner in a consistent manner, a method was devised to look for location of the rank and suit information by using column sums of selected indices of the signal, which can work even when different brands of cards with different symbol images are used, without the necessity of retraining the system or redesigning the signal conditioning hardware components (such as FPGA's) to match specific symbol types. This is a distinct advantage over most disclosed systems that require specially marked cards or training for each type of card used. In addition, cards can be fed straight over the scanner or can be skewed. Location of the rank/suit symbols is deduced from information about where the sums are low (indicating an absence of a marking). This feature allows the sensed objects to be located in different areas in the larger sensing area and allows the device to successfully locate and compare the vectors.

Figure 11:
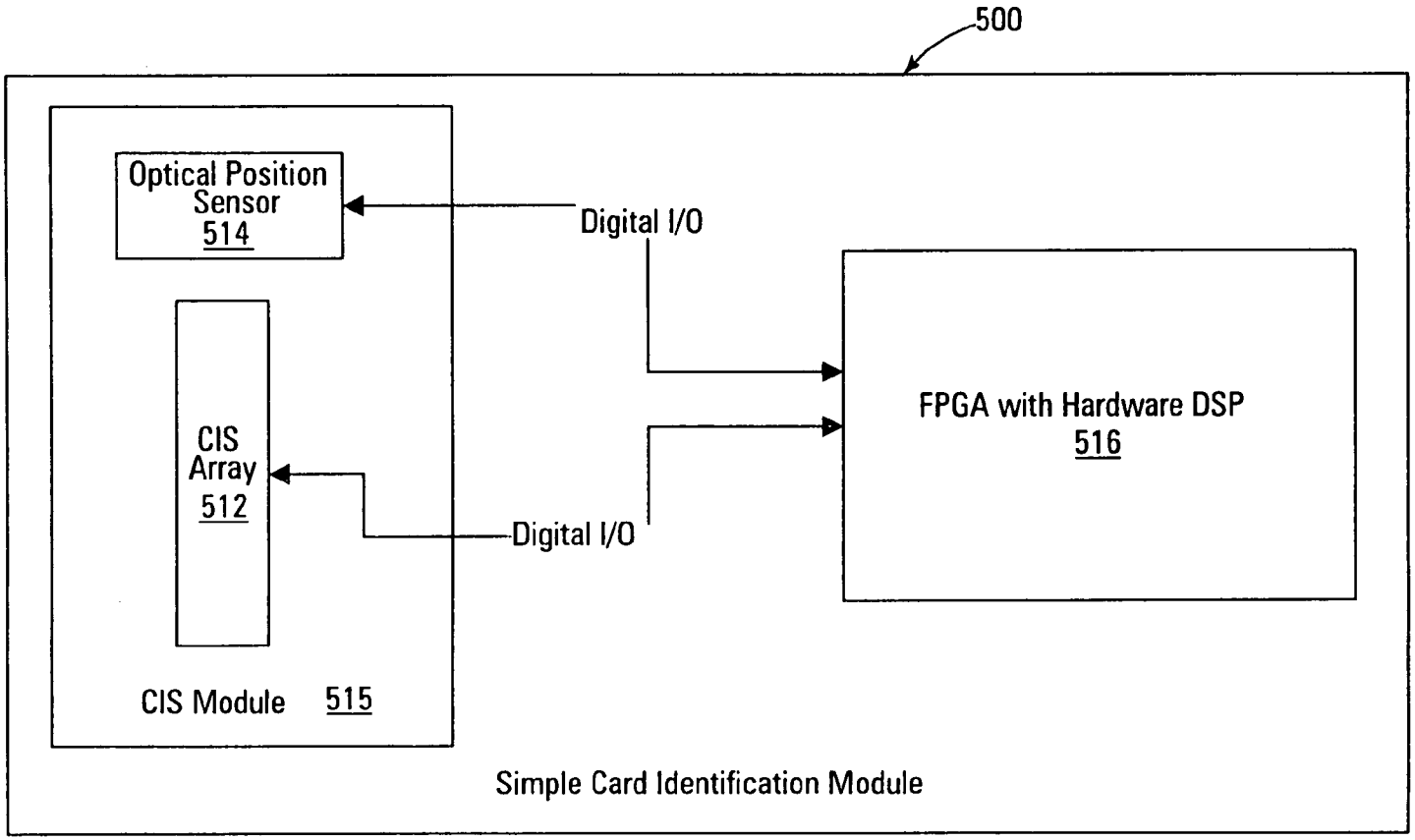
FIG. 11 shows a schematic view of an exemplary card identification module.

Referring now to FIG. 11, this technique may be implemented by providing an intelligent imaging board 500 utilizing an optical position sensor 514 that resides on the CIS module 515. The optical position sensor 514 may have two purposes: 1) senses the distance that the card moves, 2) senses the presence of a card. The sensor may be positioned at a specific location of the device where it can detect the card position changes, $\Delta x$, (shown in FIG. 12) as the card moves through or over the sensor. The sensor continuously outputs the changes of the card's position to the FPGA 516. In one form of the invention, the sensor communicates with the FPGA via a digital input/output port.

The CIS sensor 512 also resides on the CIS module 515. A suitable CIS module can be purchased by ordering part number M106-A9 from CMOS Sensor, 20045 Stevens Creek Blvd., Suite 1A, Cupertino, Calif. 95014. The sensor acts as a line sensor (that is, it senses optical density of narrow sections of an image (essentially 1-dimensional), one line at a time), and is able to be re-triggered to read a new line every time the card moves certain distances or certain periods of time during movement, or at any other basis of providing intervals (spaced line scans) along the card symbol. The output voltage of each scanning segment of the CIS line scanner represents a shade of gray, since the exemplary system is a black and white reading system. This output voltage is converted to binary numbers within the CIS module. Output to the FPGA is a data set of binary numbers. Color scanning may be used, but it is essentially redundant or superfluous with respect to the needed image content for determining suit and rank.

Figure 12:
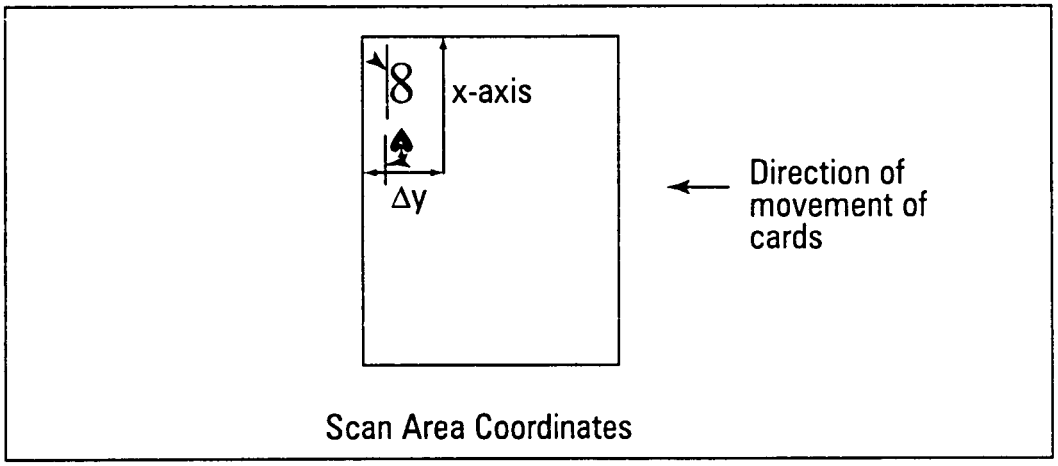
FIG. 12 shows a schematic diagram of a card being scanned.

The proposed system scans lines bisecting an area of the card face containing the symbols one line at a time. The area to be scanned is defined by coordinates X and Y. The CIS array 512 and the optical position sensor 514 read the x and the y directions respectively. FIG. 12 shows the coordinates of the area.

The CIS module 515 may output two signals to the FPGA: 1) the binary data that is captured by the CIS, and 2) its related position captured by the optical position sensor. This output of the CIS module will be one continuous vector including a number of numerical values, each being either a zero or a 1. The output is a signal representing a linear vector, not a two-dimensional array. The CIS module converts the voltage signals to binary values. In alternate forms of the invention, voltages are converted to binary values in the FPGA or within another hardware device.

To determine whether a card rank and suit has been scanned, the system must first be trained or hardwired to recognize card rank and suit. To accomplish this, a single reference vector for each rank (A, K, Q, J, 10, 9, 8, 7, 6, 5, 4, 3, 2) and a single reference vector for each suit (Hearts, Clubs, Diamonds and Spades) is generated and saved (e.g., a known vector is saved for each symbol) by acquiring a set of signals during a training phase, by hardwiring the system based upon a known set of card symbols or by using a large tolerance hardwiring for a range of symbols. The signals acquired during training undergo the same binary conversion and are stored in memory of an associated processor. The data is transferred from this memory to the FPGA at run time. During signal processing, the reference vectors are not converted into images. The reference vectors are a type of abbreviated data set (analogous to a hash value derived from a larger data set) useful in shape matching and advantageously are much smaller data sets requiring lower processing and storage capability.

During the identification process, an unknown vector is acquired when a triggering signal is detected. This unknown vector, as indicated above, is converted into a binary signal. The triggering signal can take on many forms. The triggering mechanism can be an edge sensor (indicating that a first leading edge of a playing card has passed over an optical or motion sensor, a motion sensor indicating movement of a playing card, optical sensor indicating the presence of optical density other than white (e.g., a card sensor) over an optical sensor, or the like. Upon triggering of the spaced scan line sensor, the scanning may continue on a timed, or sensed (e.g., distance or speed of movement of the card, degree of variation in the signal from the line sensor, etc.) basis. In the preferred and most simplified system, all cards are drawn by a dealer manually; so the speed of removal of each drawn card (and the speed of scanning) varies. A speed sensing or variation sensing device would therefore be more appropriate, rather than a timed sensor. When automated movement is provided, as for example in Example 2 by feeding individual cards into the dealer recovery position, timed triggering may be more appropriate. The unknown vector is then correlated with the known vectors to determine a match and identify the card's rank and suit. At no time are images reconstructed and compared. Instead, the abbreviated acquired data sets are compared and correlated with stored reference data sets to determine rank and suit.

Cross correlation of 2D discrete signals A and B may be defined as following equation, where 'A' is the unknown signal and 'B' is the template signal.

$$\frac{\sum\sum A*B}{\sqrt{\sum\sum A*A*\sum\sum B*B}} \quad (1)$$

Obviously this is a complex operation requiring significant computational power. However, for a binary signal as constrained as described, the correlation reduces to a simple binary AND operation and summation of the result over the entire vector. Then in template matching, it can be shown mathematically that for the 2D case of shifting the template over a 2D matrix, this concept can be transferred to a 1D vector by shifting the order of the vector.

To match the card, a series of 'Correlators' is generated in the FPGA on power up. The correlators are used to correlate all known rank and suit information with the unknown vector either sequentially, or preferably concurrently. The unknown vector is then shifted and a new series of correlations performed. (The term "shifted" means that the top two values of the series of values that constitutes the entire vector (each being a zero or a 1) is removed from the top of the vector and placed at the bottom of the vector, changing the order of the number pairs in the vector. For example, a simple vector might be the following order pairs:

0,0
0,1
1,1
1,1
1,0
1,0
0,0
0,1

By shifting the top pair to the bottom, the vector becomes:

0,1
1,1
1,1
1,0
1,0
0,0
0,1
0,0

This process is continued over a wide range of shifts. The results of the correlations are saved, compared and the maximum correlation value (with respect to the known vectors) is used to identify rank and suit.

Figure 13:
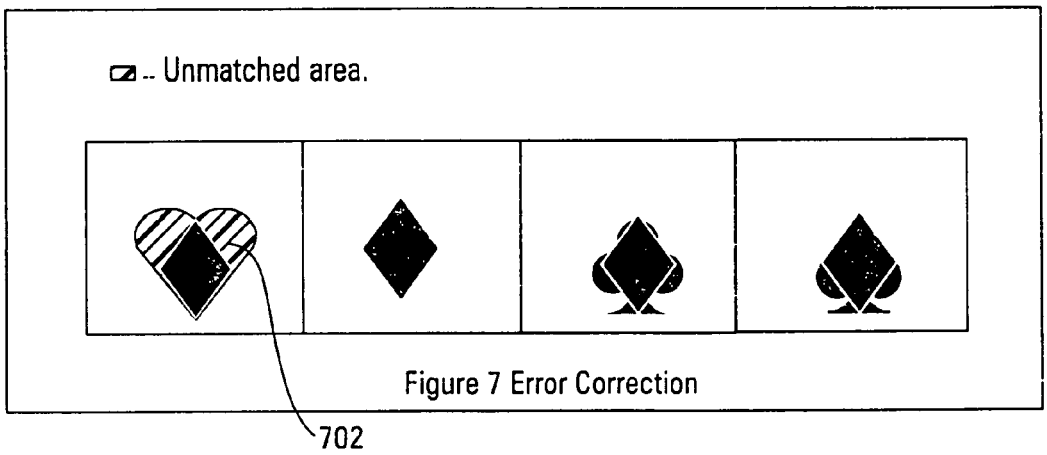
FIG. 13 is a schematic diagram illustrating unmatched areas of shapes.

The inventors originally encountered a problem in correctly identifying the suit of the cards using the cross correlation technique: a "diamond" is read as the "heart". This is because the diamond shape can be fit into the heart shape, see FIG. 13C for illustration. As a result, the diamond shape could have been reported as both heart and diamond by the FPGA Card Identification Module. To avoid this type of misread, the inventor uses the error correction function to compares the "un-matched" area 702 of the shapes. The error correction function is defined as the following equation:

$$\Sigma\Sigma A*B-\Sigma\Sigma A'*B \quad (2)$$

By using the technique, the device is able to detect the unmatched area (see FIG. 13), therefore identifies the correct shape.

The proposed device is preferably implemented using FPGA technology (rather than using only a microprocessor and memory) to improve the speed of identifying cards and dramatically reduce the cost. Speed is improved because operations are performed in real time with hardware logic circuits and not with software running on a processor. Costs are reduced because there is no longer any need for complex computational capability. Following a card identification cycle, the card ID data can be stored locally by a database storage system, the processor and/or transmitted to a remote location for storage. One proposed card delivery device that utilizes the simple card identification method described above is preferably a manual card deliver shoe as described in Example 1. The card delivery device can deliver single or multiple decks of cards. This is different from the intelligent Shoe described in the second example above, as this first device does not necessarily have a motor and other mechanical elements.

Figure 14:
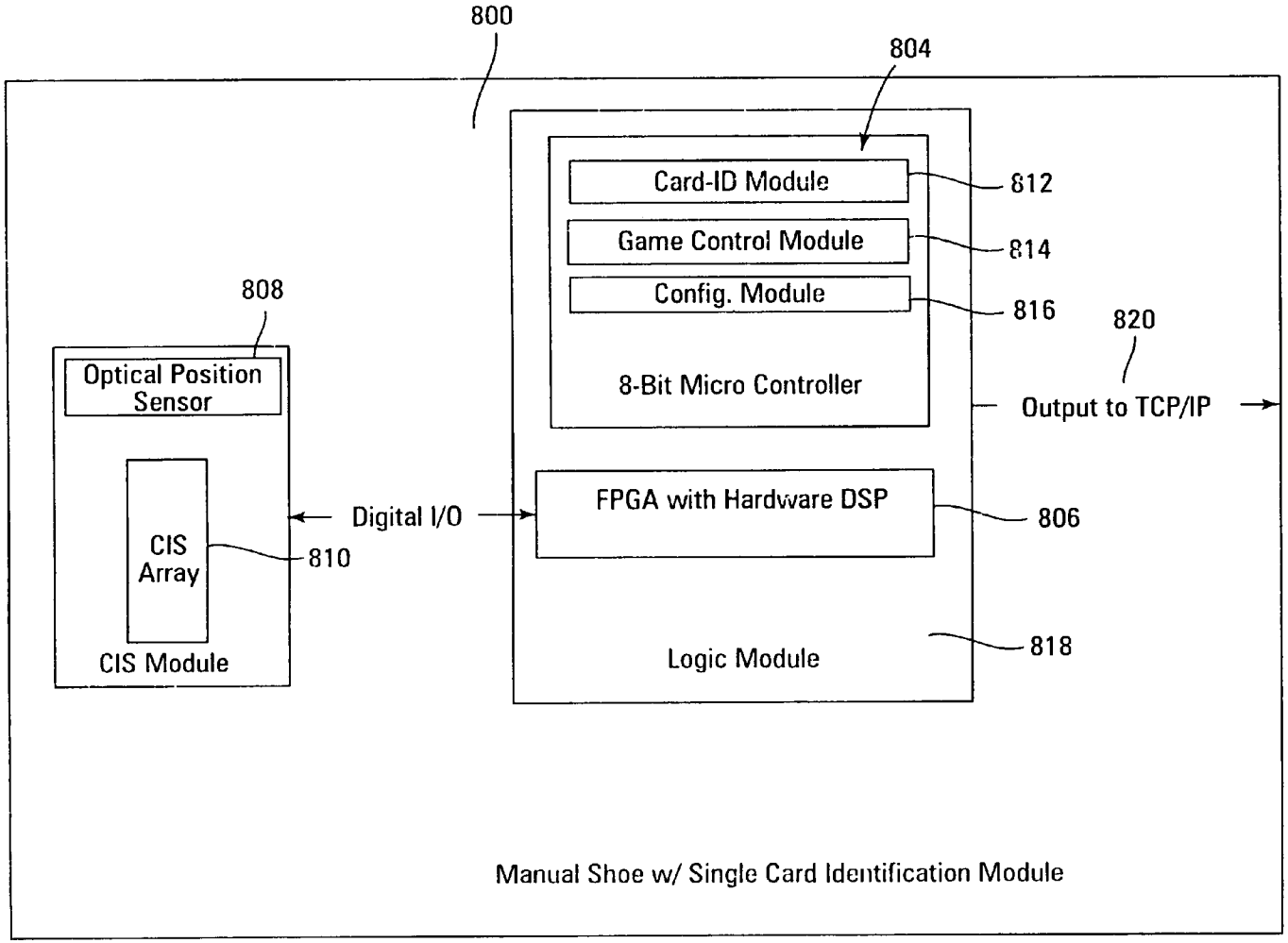
FIG. 14 is a schematic diagram of a card identification module of a dealing shoe of the present invention.

An exemplary control module of the first exemplary dealing shoe is described in more detail in FIG. 14. This particular module is most suitable for the game of baccarat. There are two main internal hardware components: the Contact Image Sensor Module 802 and the Logic Module 818.

The CIS module 802 is preferably located near the exit of the shoe. As indicated above, the card reading system has applicability and utility within the housing of the delivery shoe or a card shuffler, such as the shuffler with integrated dealing shoe disclosed in U.S. Pat. No. 6,254,096, the content of which is hereby incorporated by reference. This logic module 818 replaces an external mini PC and acts as a communication channel of the device. There may be, for example, an 8-bit microcontroller 804 and the FPGA 806 that both reside on this exemplary logic module. There are three software modules that reside on the microcontroller 804, they are:

The Card-ID module 812 that reads the output of the FPGA and transmits or saves data as appropriate per game rules. This module has associated memory that retains the reference vector data.

The game control module 814 that has the capabilities of reconstructing the hands and determining the outcome of each round. This information is sent out from the logic module as the shoe output via the TCP/IP communication port.

The game configuration module 816 with its imbedded web server gives the user the capability to change the configuration of the Baccarat Hand Reconstruction module, as well as options for the shoe from a remote location.

There are a number of independent and/or alternative characteristics of the mechanized delivery shoe of the second Example of the invention that are believed to be unique in a device that does not shuffle, sort, order or randomize playing cards.

1) Shuffled cards are inserted into the shoe for dealing and are mechanically moved through the shoe but not necessarily mechanically removed from the shoe.
2) The shoe may optionally mechanically feed the cards (one at a time) to a buffer area where one, two or more cards may be stored after removal from a card input area (before or after reading of the cards) and before delivery to a dealer accessible opening from which cards may be manually removed.
3) An intermediate number of cards are positioned in a buffer zone between the input area and the removal area to increase the overall speed of card feeding with rank and/or suit reading and/or scanning to the dealer.
4) Sensors indicate when the dealer accessible card delivery area is empty and cards are automatically fed from the buffer zone (and read then or earlier) one-at-a-time.
5) Cards are fed into the dealer shoe as a vertical stack of face-down cards, mechanically transmitted approximately horizontally, read, and driven into a delivery area where cards can be manually removed.
6) Sensors detect when a card has been moved into a card reading area. Signal sensors can be used to activate the card reading components (e.g., the camera and even associate lights) so that the normal symbols on the card can be accurately read.

With regard to triggering of a scanner, a triggering mechanism can be used to set the scan at an appropriate time when the card face is expected to be in close proximity to the scanner. Such triggers can include one or more of the following, such as optical position sensors within an initial card set receiving area, an optical sensor and, a nip pressure sensor (not specifically shown, but which could be within either nip roller, edge sensor, light cover sensor, and the like). When one of these triggers is activated, the scanner is instructed to time its shot to the time when the symbol containing corner of the card is expected to be positioned within the focal area of the scanner. The card may be moving at this time and does not have to be stopped. The underlying function is to have some triggering in the device that will indicate with a sufficient degree of certainty when the symbol portion of a moving or moved card will be with the scanner's focal area. A light associated with the scanner may also be triggered in tandem with the scanner so as to extend the life of the light and reduce energy expenditure in the system.

The above structures, materials and physical arrangements are exemplary and are not intended to be limiting. Angles and positions in the displayed designs and figures may be varied according to the design and skill of the artisan. Travel paths of the cards need not be precisely horizontal from the card input area to the delivery area of the shoe, but may be slightly angled upwardly, downwardly or varied across the path from the card input area to the card delivery area. The cards may be sensed and/or read within the shoe while they are moving or when they are still at a particular location within the shoe. The dealing shoes of the present invention may be integrated with other components, subcomponents and systems that exist on casino tables for use with casino table games and card games. Such elements as bet sensors, progressive jackpot meters, play analysis systems, wagering analysis systems, player comping systems, player movement analysis systems, security systems, and the like may be provided in combination with the baccarat shoe and system described herein. Newer formats for providing the electronics and components may be combined with the baccarat system. For example, new electronic systems used on tables that provide localized intelligence to enable local components to function without absolute command by a central computer are desirable.

What is claimed:

1. An apparatus for the determination of at least one of rank or suit of a playing card comprising:

a container from which cards are individually removed for delivery to a card game;

at least one line scanner within the container or at an exit end of the container;

wherein the line scanner provides a signal when playing cards are moved over the reading system or imaging system, wherein the signal is communicated to a hardware component that identifies at least one of rank and suit from the signal and transmits data indicating the at least one of rank or suit so that the at least one of rank or suit can be identified;

wherein the container includes a card exit end, and a partial barrier is provided proximate the card exit end to reduce size of an opening through which an exiting card can pass.

2. The apparatus of claim 1, wherein the container is a nonmechanized shoe and the partial barrier is adjustable to accommodate a thickness of a playing card.

3. The apparatus of claim 1, wherein the container is a mechanized shoe and the partial barrier is adjustable to accommodate a thickness of a playing card.

4. The apparatus of claim 1, wherein the container is a shoe, and wherein the line scanner is located at an exit end of the shoe.

5. The apparatus of claim 4, wherein cards are scanned as the card is manually removed from the shoe.

6. The apparatus of claim 4, wherein suit and rank is identified in real time.

7. The apparatus of claim 4, wherein the container includes an exit end, and a partial barrier is provided proximate the exit end to reduce a size of an opening for an exiting card to pass.

8. The apparatus of claim 7, wherein the partial barrier is adjustable in height, adjusting a size of the opening.

9. An apparatus for reading symbols from playing cards in which playing cards are manually removed from a chute having an upper interior surface and a lower support surface, the apparatus comprising:

a line scanner that scans lines bisecting images printed on playing cards at spaced intervals in at least the region where suit and rank symbols are provided on the playing cards and output signals are converted into binary data used to identify at least one of a suit or rank of the playing card imaged, wherein the upper interior surface has a partial barrier for cards fixed over the interior surface, the partial barrier having an elevated surface, the elevated surface defining a height of a pathway for cards between the upper interior surface and the lower support surface.

10. The apparatus of claim 9 wherein the acquired binary data is compared to stored binary data to determine rank and suit.

11. The apparatus of claim 10 wherein the line scanner comprises a contact image system.

12. The apparatus of claim 9 wherein the binary data is inputted to a FPGA or ASIC and is compared to reference vector sets to determine at least one of a suit or rank of the playing card imaged.

13. The apparatus of claim 9 wherein the binary data is correlated with known signals within a hardware component to identify the at least one of a suit or rank of the playing card imaged.

14. An apparatus for reading symbols from playing cards comprising:

a contact image line scanner, the scanner comprising:

a motion scanner, and a line scanner, the motion scanner triggering operation of the line scanner to provide signals from spaced line scans of playing card symbols passed over the scanner, wherein signals from the motion scanner and line scanner are fed into a hardware component that generates a vector corresponding to the image and wherein the apparatus is mounted in a card delivery device with an exit opening, and further comprising an adjustable partial barrier within the exit opening to limit a number of cards exiting to one by changing height within the exit opening.

15. The apparatus of claim 14 wherein the line scanner comprises a contact image sensor.

16. The apparatus of claim 14 wherein the contact image line scanner provides multiple spaced line scans of the playing card symbols.

17. The apparatus of claim 14 wherein the signals are provided to a hardware component selected from the group consisting of a FPGA and an ASIC to form a vector set corresponding to the image.

18. The apparatus of claim 14, wherein the partial barrier is adjustable.

19. A method of identifying the rank and suit of a playing card comprising:

manually pulling a playing card through a pathway having an upper plate with an interior surface;

a reader automatically taking spaced line scans of rank and suit symbols on the playing card as the playing cards are pulled out of the pathway, generating scan signals, a processor correlating scan signals and known signals to identify the rank and suit by closest correlation of the operating symbols and the known symbols, and limiting a size of the pathway by an at least partial barrier so that no more than one card can exit from the pathway at a time.

20. The method of claim 19 wherein a size of the pathway is adjustable by adjusting height on the at least partial barrier.

21. The method of claim 19 where the spaced line scans are triggered automatically by a motion sensor.

22. The method of claim 19 wherein the scan signals comprise an analog signal that is converted to a binary signal within the scanner.

23. A method for identifying suit and rank on playing cards comprising: manually pulling a card through a pathway having a height defined by a lower support surface and a partial barrier supported on an interior surface of a front plate, the partial barrier inside the pathway limiting passage of cards through the pathway to one card at a time, passing symbols on a playing card over a line scanner while part of the playing card is under the partial barrier, taking spaced line scans of the symbols, providing signals from the scanner, and a processor identifying suit and rank of the playing card based upon the signals.

24. The method of claim 23 wherein the partial barrier is adjusted to change the height of the pathway before a card is pulled through the pathway.

25. The method of claim 23 wherein identifying suit and rank based upon the signals comprises providing a voltage signal indicative of a gray scale value within a range of gray scale values and converting the voltage into a binary number.

26. The method of claim 23, wherein a monochromatic light source is used to provide light to the imager.

27. The method of claim 23, wherein a monochromatic green light source is used.

28. The method of claim 23, wherein a monochromatic red light source is used.

29. The apparatus of claim 1, and further comprising a light source for the line scanner selected from the group consisting of green and blue light.

30. The apparatus of claim 9, wherein a monochromatic light source is used to illuminate an imaged scanned by the scanner.

31. The apparatus of claim 30, wherein the monochromatic light source is selected from the group consisting of green light and blue light.

32. The apparatus of claim 14, wherein the line scanner utilizes a monochromatic light source.

33. The apparatus of claim 32, wherein the monochromatic light source is selected from the group consisting of green light and blue light.

* * * * *